US007036445B2

(12) United States Patent
Kaufmann et al.

(10) Patent No.: US 7,036,445 B2
(45) Date of Patent: May 2, 2006

(54) WATERCRAFT STEER-BY-WIRE SYSTEM

(75) Inventors: Timothy W. Kaufmann, Frakenmuth, MI (US); James M. Petrowski, Saginaw, MI (US); Scott A. Millsap, Grand Blanc, MI (US); Stephen V. Gillman, Grand Blanc, MI (US); James M. Card, Light House Point, FL (US); Ashok Chandy, Fenton, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/643,512

(22) Filed: Aug. 19, 2003

(65) Prior Publication Data

US 2004/0031429 A1 Feb. 19, 2004

Related U.S. Application Data

(63) Continuation-in-part of application No. 10/349,601, filed on Jan. 23, 2003, now abandoned.

(60) Provisional application No. 60/356,462, filed on Feb. 13, 2002.

(51) Int. Cl.
*B63H 25/00* (2006.01)

(52) U.S. Cl. ..... 114/144 RE; 701/21

(58) Field of Classification Search ..... 114/144 R, 114/144 E, 144 RE; 701/21, 42, 43, 44
See application file for complete search history.

(56) References Cited

U.S. PATENT DOCUMENTS 4,129,087 A * 12/1978 Dimmick et al. ..... 114/144 E
4,595,867 A * 6/1986 Cognevich, Sr. et al. ... 318/588
4,800,974 A 1/1989 Wand et al. ..... 180/79.1
4,860,844 A 8/1989 O'Neil ..... 180/79.1
4,869,335 A 9/1989 Takahashi ..... 180/140
4,951,199 A 8/1990 Whitehead ..... 364/424.05
5,001,637 A 3/1991 Shiraishi et al. ..... 364/424.05
5,044,956 A 9/1991 Behensky et al. ..... 434/45
5,228,757 A 7/1993 Ito et al. ..... 303/100
5,251,135 A 10/1993 Serizawa et al. ..... 364/424.05

(Continued)

FOREIGN PATENT DOCUMENTS

EP 0278366 B1 2/1988

(Continued)

OTHER PUBLICATIONS

U.S. Appl. No. 60/322014, filed Sep. 14, 2001.*

(Continued)

*Primary Examiner*—Sherman Basinger
(74) *Attorney, Agent, or Firm*—Michael D. Smith

(57) ABSTRACT

A watercraft steer-by-wire control system for watercraft comprising: a direction control system including a rudder position sensor; a helm control system including at least one of; a helm position sensor to produce and transmit a helm position signal and an optional torque sensor to produce and transmit a helm torque sensor signal. The system optionally including a watercraft speed sensor and a master control unit in operable communication with the watercraft speed sensor, the helm control system, and the direction control system. The master control unit includes a position control process for generating the directional command signal in response to the watercraft speed signal, the helm torque sensor signal and the helm position signal. The master control unit includes a torque control process for generating the helm command signal, based on the helm torque sensor signal, the helm position signal and the watercraft speed signal.

84 Claims, 8 Drawing Sheets

U.S. PATENT DOCUMENTS

| | | | | |
|---|---|---|---|---|
| 5,257,828 | A | 11/1993 | Miller et al. | 180/79.1 |
| 5,307,892 | A | 5/1994 | Phillips | 180/79.1 |
| 5,338,250 | A | 8/1994 | Swilley et al. | 452/136 |
| 5,347,458 | A | 9/1994 | Serizawa et al. | 364/424.05 |
| 5,374,877 | A | 12/1994 | Imaseki et al. | 318/34 |
| 5,429,548 | A | 7/1995 | Long et al. | 452/127 |
| 5,449,199 | A | 9/1995 | Heinrichs et al. | 280/775 |
| 5,475,289 | A | 12/1995 | McLaughlin et al. | 318/432 |
| 5,513,720 | A | 5/1996 | Yamamoto et al. | 180/141 |
| 5,576,957 | A | 11/1996 | Asanuma et al. | 364/424.05 |
| 5,653,304 | A | 8/1997 | Renfroe | 180/402 |
| 5,668,722 | A | 9/1997 | Kaufmann et al. | 701/41 |
| 5,704,446 | A | 1/1998 | Chandy et al. | 180/446 |
| 5,717,590 | A | 2/1998 | Mihalko | 364/424.051 |
| 5,719,766 | A | 2/1998 | Bolourchi et al. | 364/424.052 |
| 5,740,040 | A | 4/1998 | Kifuku et al. | 364/424.05 |
| 5,765,116 | A | 6/1998 | Wilson-Jones et al. | 701/41 |
| 5,774,819 | A | 6/1998 | Yamamoto et al. | 701/41 |
| 5,828,972 | A | 10/1998 | Asanuma et al. | 701/41 |
| 5,829,547 | A | 11/1998 | Fujii et al. | 180/422 |
| 5,890,081 | A | 3/1999 | Sasaki | 701/37 |
| 5,913,375 | A | 6/1999 | Nishikawa | 180/168 |
| 5,925,083 | A | 7/1999 | Ackermann | 701/41 |
| 5,957,987 | A | 9/1999 | Sudo et al. | 701/41 |
| 6,018,691 | A | 1/2000 | Yamamoto et al. | 701/41 |
| 6,055,467 | A | 4/2000 | Mehring et al. | 701/23 |
| 6,059,068 | A | 5/2000 | Kato et al. | 180/402 |
| 6,076,627 | A | 6/2000 | Bohner et al. | 180/422 |
| 6,079,513 | A | 6/2000 | Nishizaki et al. | 180/402 |
| 6,097,286 | A | 8/2000 | Discenzo | 340/465 |
| 6,098,296 | A | 8/2000 | Perisho, Jr. et al. | 33/203 |
| 6,102,151 | A | 8/2000 | Shimizu et al. | 180/446 |
| 6,152,254 | A | 11/2000 | Phillips | 180/422 |
| 6,154,695 | A | 11/2000 | Shimizu et al. | 701/41 |
| 6,173,221 | B1 | 1/2001 | Boehringen et al. | 701/41 |
| 6,176,341 | B1 | 1/2001 | Ansari | 180/402 |
| 6,179,394 | B1 | 1/2001 | Browalski et al. | 303/146 |
| 6,208,923 | B1 | 3/2001 | Hommel | 701/42 |
| 6,209,677 | B1 | 4/2001 | Bohner et al. | 180/406 |
| 6,213,248 | B1 | 4/2001 | Kawaguchi et al. | 180/446 |
| 6,219,604 | B1 | 4/2001 | Dilger et al. | 701/41 |
| 6,240,350 | B1 | 5/2001 | Endo | 701/41 |
| 6,244,372 | B1 | 6/2001 | Sakamaki et al. | 108/422 |
| 6,273,771 | B1 * | 8/2001 | Buckley et al. | 440/84 |
| 6,279,674 | B1 | 8/2001 | Lissel et al. | 180/402 |
| 6,279,675 | B1 | 8/2001 | Bohner et al. | 180/403 |
| 6,283,243 | B1 | 9/2001 | Bohner et al. | 180/406 |
| 6,285,936 | B1 | 9/2001 | Bohner et al. | 701/41 |
| 6,363,305 | B1 | 3/2002 | Kaufmann et al. | 701/41 |
| 6,370,460 | B1 * | 4/2002 | Kaufmann et al. | 701/41 |
| 6,450,287 | B1 | 9/2002 | Kurishige et al. | 180/446 |
| 6,469,664 | B1 * | 10/2002 | Michaelson et al. | 342/357.13 |
| 6,535,806 | B1 * | 3/2003 | Millsap et al. | 701/42 |
| 6,655,490 | B1 * | 12/2003 | Andonian et al. | 180/402 |
| 6,687,588 | B1 * | 2/2004 | Demerly et al. | 701/41 |
| 2002/0079155 | A1 | 6/2002 | Andonian et al. | 180/402 |
| 2002/0084757 | A1 | 7/2002 | Ewbank et al. | 318/34 |
| 2002/0107621 | A1 | 8/2002 | Byers et al. | 701/41 |
| 2002/0129988 | A1 * | 9/2002 | Stout et al. | 180/400 |

FOREIGN PATENT DOCUMENTS

| | | | |
|---|---|---|---|
| EP | 0858408 | B1 | 10/1996 |
| EP | 0985591 | A1 | 8/1999 |
| GB | 23415688 | A | 2/2000 |
| JP | 60256570 | | 12/1985 |
| JP | 1115778 | | 5/1989 |
| JP | 8034353 | | 2/1996 |
| WO | 00/34106 | | 6/2000 |

OTHER PUBLICATIONS

U.S. Appl. No. 60/356462, filed Feb. 12, 2002.*

J.Y. Wong, Ph.D., "Chapter Five: Handling Characteristics of Road Vehicles," *Theory of Ground Vehicles,* 1978, pp. 210-214.

* cited by examiner

WATERCRAFT STEER-BY-WIRE SYSTEM

CROSS-REFERENCE TO RELATED APPLICATIONS

This is a continuation-in-part application of U.S. Ser. No. 10/349,601, filed Jan. 23, 2003, now abandoned, which, claims the benefit of U.S. provisional application No. 60/356,462 filed Feb. 13, 2002 the contents of which are incorporated by reference herein in their entirety.

BACKGROUND

In conventional watercraft steering assemblies, the operator controls the direction of the watercraft with the aid of a helm control e.g., helm or helm input. Prior mechanisms for directional control of a watercraft employ a mechanical interconnection such as a cable with one end attached to a steering input e.g., wheel or helm while the other end is attached to the steerable member 10 (such as an outboard unit/drive, directed propulsion, or rudder). To aid the operator, this attachment maybe further attached to a device to provide additional power boost in systems that may utilize an auxiliary system to generate the force transmitted to a steerable member, such as when there is substantial load. The additional force reduces the effort required by the operator for changing the direction. Typically, this auxiliary force is generated by either a hydraulic drive or an electric motor. These steering mechanisms usually exhibit a constant ratio from steering input (hand or steering wheel) displacement to the steerable member. Moreover, the response of the steerable member (an angle of a rudder for instance) is not a function of watercraft speed and/or throttle position.

BRIEF SUMMARY

The above discussed and other drawbacks and deficiencies are overcome or alleviated by a system and method for steering a watercraft.

Disclosed herein is a watercraft steer-by-wire control system for watercraft comprising: a direction control system responsive to a directional command signal for steering a watercraft, the direction control system including a rudder position sensor to measure and transmit a rudder position signal and a helm control system responsive to a helm command signal for receiving a directional input to a helm from an operator and providing tactile feedback to an operator, the helm control system including at least one of; a helm position sensor to produce and transmit a helm position signal and an optional torque sensor to produce and transmit a helm torque sensor signal. The steer-by-wire system for watercraft also includes an optional watercraft speed sensor for producing a watercraft speed signal; and a master control unit in operable communication with the watercraft speed sensor, the helm control system, and the direction control system. The master control unit includes a position control process for generating the directional command signal in response to the watercraft speed signal, the helm torque sensor signal and the helm position signal. The master control unit includes a torque control process for generating the helm command signal, based on the helm torque sensor signal, the helm position signal and the watercraft speed signal.

Also disclosed herein is method for steering a watercraft with a steer-by-wire system comprising: receiving an optional watercraft speed signal; receiving a helm position signal; receiving an optional helm torque sensor signal; and receiving a rudder position signal. The method for steering a watercraft with a steer-by-wire system also comprises: generating a helm command signal to a helm control system based on the helm torque signal, the helm position signal and the watercraft speed signal to provide tactile feedback to an operator; and generating a directional command signal to a direction control system based on the watercraft speed signal, the rudder position signal, and the helm position signal to control direction of the watercraft.

Further disclosed herein is a storage medium encoded with a machine-readable computer program code, the computer program code including instructions for causing controller to implement the above-mentioned method for steering a watercraft with a steer-by-wire system.

Also disclosed herein is a computer data signal, the data signal comprising code configured to cause a controller to implement the abovementioned method for steering a watercraft with a steer-by-wire system.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several figures.

DETAILED DESCRIPTION OF AN EXEMPLARY EMBODIMENT

Disclosed herein in an exemplary embodiment is steering system employing control-by-wire technology to enhance the directional control capabilities of marine craft. Control-by-wire technology eliminates the mechanical linkages in systems by sensing desired inputs such as helm position and generates commands to drive an output device. The output device may be an electric motor, actuator, hydraulic actuator, and the like, as well as combinations including at least one of the foregoing, which is responsive to the commands and manipulates a steerable member such as a rudder and hereinafter denoted rudder.

As stated earlier, prior mechanisms for directional control of a watercraft employ a mechanical interconnection while the other end is attached to the steerable member. One advantage in having a direct connection to a steerable member is that the operator receives tactile feedback via the steering linkages through to the helm control and the phase relationship between the operator's input and the responses is substantially fixed. For example, if the watercraft changes directions while it is moving, the operator will feel resistance in the helm and the response of the steerable member follows inputs at the helm. With a steer-by-wire system, since the mechanical link between the helm and the rudder (s) is inoperative/eliminated, what the driver feels at the helm is highly tunable. Therefore, the steering system may exhibit variable desirable tactile feedback to the operator. At the same time, with the elimination of the mechanical connection, the phase relationship between the driver's helm angle input and the torque felt by the driver can change significantly.

Advantageously, a control-by-wire architecture of an exemplary embodiment as disclosed herein allows the angle between the helm angle and the steerable member to be variable. Features/functions of this embodiment include, but are not limited to providing resistive torque or feedback to the operator that may be programmed to enhance steering tactile feedback (feel). Additionally, an autopilot function for direction control and guidance may readily be integrated with or without movement of the helm when active. Additional features of an exemplary embodiment include low speed directional control (docking, no wake speeds, and the like) enhancements. Steer-by-wire facilitates implementations that operate multiple steering devices concurrently.

Figure 1:
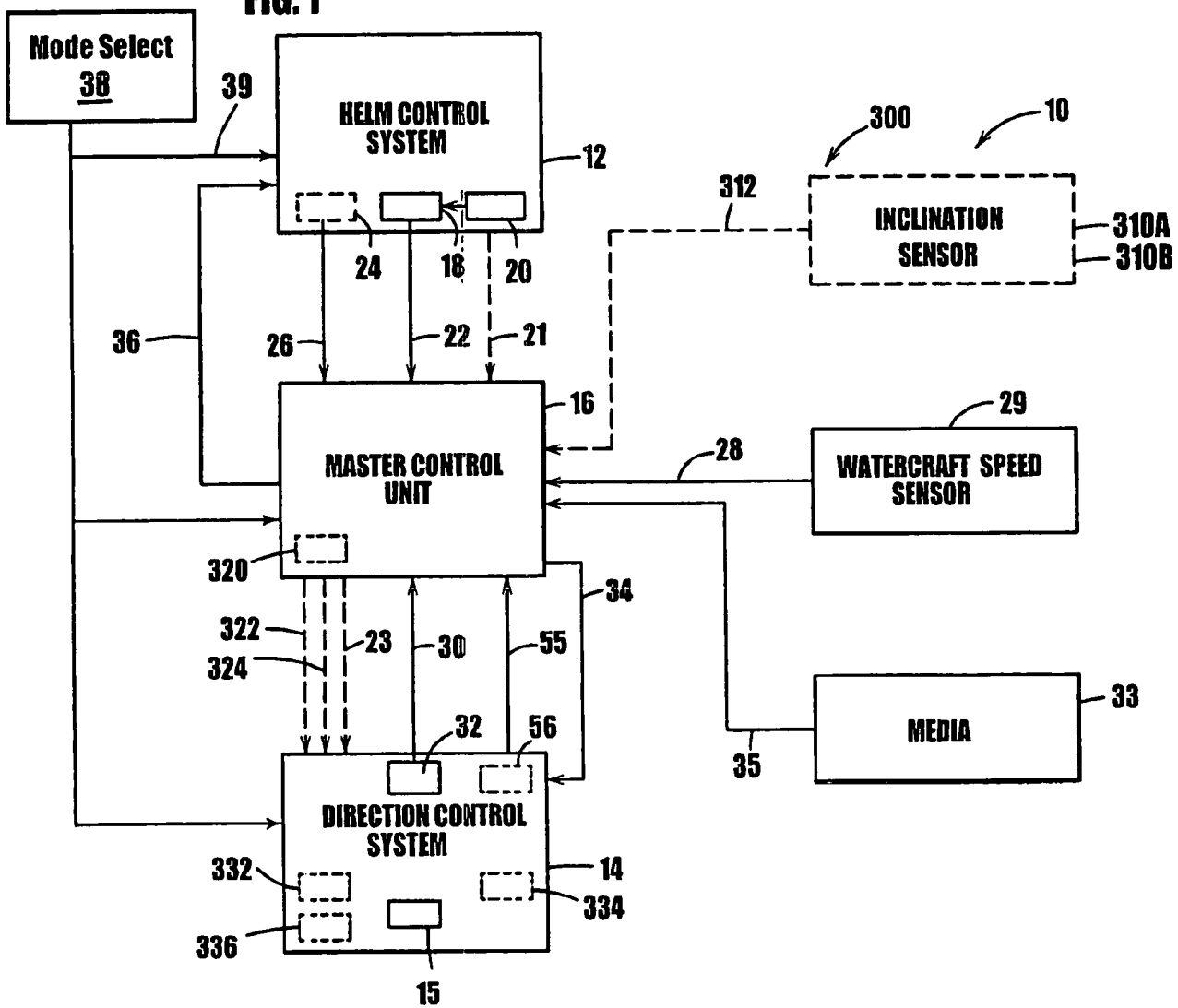
FIG. 1 is a block diagram illustrating a watercraft steer-by-wire control system in one embodiment of the present invention.

Referring now to FIG. 1, an exemplary control-by-wire watercraft control system 10 is depicted. An exemplary watercraft control system 10 includes, but is not limited to a helm control system 12, a direction control system 14, and a master control unit 16. The helm control system 12 includes a helm position sensor 18 to detect the position and movement of a helm 20 or any equivalent operator input device and sends a helm position signal 22 to the master control unit 16. The helm control system 12 may optionally include a helm torque sensor 24 to detect the torque applied to the helm and sends a helm torque signal 26 to the master control unit 16. The master control unit 16 combines the information of the helm position signal 22 helm torque signal 26, with a watercraft speed signal 28 from a watercraft speed sensor 29, and rudder position signal 30 from a rudder position sensor 32 that detects the position of the rudder 15 in the direction control unit 14. Using these input signals, the master control unit 16 produces a directional command signal 34 that is sent to the direction control system 14. In addition, a helm command signal 36 optionally, may be transmitted to the helm control system 12. It will be appreciated, as described further herein, that the helm control system 12 may employ either a passive torque control (e.g., as an brake and open loop) or active torque control (e.g., with an motor and either open or closed loop). Moreover, it will be appreciated that the inclusion of a torque sensor 24 may be a function of implementation for a given embodiment. For example, if the position sensor is located at a position away or "downstream" from a compliant member (as may be employed for a torque sensor) then the position sensor information and torque information is needed to ascertain the true position of the helm 20.

It will be appreciated, that the helm control system 12, master control unit 16, and direction control system 14 are described for illustrative purposes. The processing performed throughout the system may be distributed in a variety of manners. For example, distributing the processing performed in the master control unit 16 among the other processes employed may eliminate the need for such a component or process as described. Each of the major systems may have additional functionality that will be described in more detail herein as well as include functionality and processing ancillary to the disclosed embodiments. As used herein, signal connections may physically take any form capable of transferring a signal, including, but not limited to, electrical, optical, or radio. Moreover, conventional position/force control of actuators, servos, and the like often utilize a feedback control system to regulate or track to a desired position/force. The control law maybe a proportional, integrative or derivative gain on the tracking error or may be a more sophisticated higher-order dynamic. In either case, the feedback measurement is the actual position/force and in some cases, it's derivatives.

Figure 2:
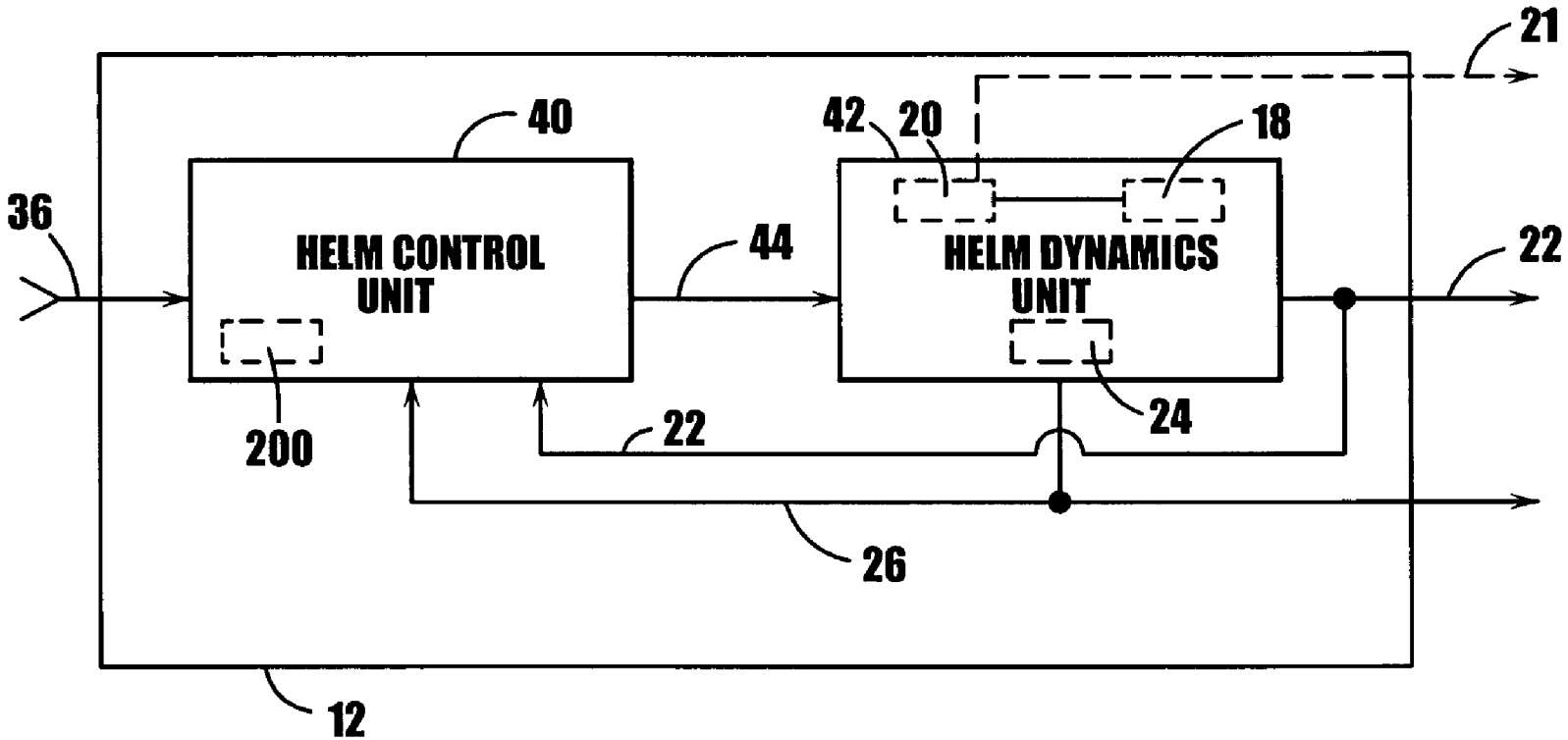
FIG. 2 is a block diagram of the helm control system of an exemplary embodiment as shown in FIG. 1.

Referring to FIG. 2, the helm control system 12 is a control system (in this instance closed loop, but not necessarily so) that uses the helm position signal 22 as sensed from the helm position sensor 18 as the feedback signal. Optionally, the helm torque signal 26 is also utilized in an exemplary embodiment, the helm command signal 36 is received from the master control unit 16 (FIG. 1) into the helm control unit 40 where the signal is compared to the helm torque signal 26. For example, a simple method of comparison is simply to subtract one signal from another. A zero result indicates that the desired torque is being applied. A compensation process 240 (FIG. 8) may be employed in the helm control unit 40 to maintain stability of the helm dynamics unit 42. The compensation process 240 (FIG. 8) is used to provide stability of the helm control system 12 at sufficient gains to achieve bandwidth greater than 3 Hz. In the case, of each local loop (helm and rudder) the bandwidth of each affects the stability of the overall system. If either direction and/or helm control systems, 14 and 12 respectively, have low bandwidth, over all stability is reduced and compensation on a higher level is required. A torque command signal 44 is then passed to the helm dynamics unit 42 as needed to comply with the helm torque command signal 36. The helm dynamics unit 42 contains the necessary elements to provide a reaction torque to the operator as well as a torque sensor 24 to provide the feedback, torque signal 18 to the helm control unit 40 as well to the master control unit 16 (FIG. 1), and a helm position sensor 18 that produces and sends the helm position signal 22. Generally, reaction torque will be imparted to the operator by an electric motor coupled to the helm 20. However, other configurations are possible. Preferred reaction torque motors are those with reduced torque ripple, such as are described in detail in commonly assigned U.S. Pat. No. 6,498,451, entitled TORQUE RIPPLE FREE ELECTRIC POWER STEERING, filed Sep. 6, 2000, the disclosures of which are incorporated by reference herein in their entirety. It is noteworthy to appreciate that a torque ripple free motor is desirable, but not required for this invention. Either type will work with the invention as disclosed and described. Finally, once again, while an exemplary embodiment has been described employing a motor to provide a reaction torque to the operator, a simple brake that provides resistance to motion or a brake and return spring (to provide a centering force) may also be utilized.

In another exemplary embodiment, resistive torque may be applied to the helm control system 12 in the case of a motor (not shown) attached to the helm 20 in the helm dynamics unit 42 to provide a center or straight ahead feel to the operator. This torque is referred to as active torque feedback. In addition, optionally, resistive passive torque may also be applied. For example, passive torque may be applied with a friction brake (not shown), optionally part of helm dynamics unit 42. This resistive force could be a function of helm 20 displacement from center as measured by the helm position sensor 18 (or rudder position from center), a detent at center, or of some other load on the watercraft control system 10. This would allow the operator to always know where center of the helm 20 control is regardless of the speed of the watercraft.

In another exemplary embodiment, the motor or brake (of the helm dynamics unit 42) can be used to communicate that the operator has reached an end of travel for the control input. For example, (in the case of variable ratio) an end of travel (e.g., stop) may be indicated by increasing the force when the helm 20 moves (commands a travel) beyond a selected limit, for example, the maximum travel of the rudder 15 (yet may not have reached another physical control travel stop). Advantageously, this end of travel stop may vary as the variable ratio changes. For instance, if in a selected configuration, the rudder 15 travel is +/−40 degrees, and the ratio can vary from 2:1 to 15:1 (helm 20 control degrees: rudder degrees) the helm 20 stops would vary from +/−80 degrees to +/−600 degrees. Additionally, the variation of the stops may be controlled depending upon a selected mechanical configuration. For example, in an exemplary embodiment, and for a configuration where the brake (not shown) and the helm position sensor 18 are located on the lower side of the helm torque sensor 24, as the operator approaches a stop, the helm control system 12 may increase the torque and stop further movement in a given direction. In this embodiment, the helm torque sensor 24 would be monitored to determine the direction of helm torque signal 26. If the helm torque signal 26 is in a direction to increase the helm control angle (from center), the brake may remain locked. If the helm torque signal is in the direction to decrease the helm 20 control angle (from center), the command to the brake may be decreased.

In yet another exemplary embodiment, the brake may be mounted on the lower side (away from the operator input at the helm) of the torque detector (an apparatus that facilitates measurement of the torque applied to the helm 20, such as a t-bar) and the helm position sensor 18 is mounted on the upper side ("closer" to the operator input at the helm) of the t-bar no electrical helm torque sensor 24 would be required and the torque sensor 24 could be optional. In this embodiment, the brake control would be a function of helm position signal 22 as measured by the helm position sensor 18. In this instance the electrical components for torques sensing need not be employed, but the t-bar or compliant member between the brake and helm 20 would be employed along with the position sensor 18 being located on the side of the t-bar closest to the helm 20.

It will further be appreciated that while particular sensors and nomenclature are enumerated to describe an exemplary embodiment, such sensors are described for illustration only and are not limiting. Numerous variations, substitutes, and equivalents will be apparent to those contemplating the disclosure herein. For example, while a torque sensor 24 and helm position sensor 18 are described to sense the helm torque signal 26 and helm position signal 22, such description is illustrative. Any sensor and nomenclature which can be utilized to measure equivalent or similar parameters is also contemplated Referring now to FIG. 3, the direction control system 14, like the helm control system 12, is also a control system (once again, closed loop in this instance, but not necessarily) that in an exemplary embodiment employs rudder position as a feedback signal. There may be a direction control system 14 for each steerable member/rudder 15 (only one is shown). In an embodiment, within the direction control system 14 the directional command signal 34 is received from the master control unit 16 and compared with a rudder position signal 30 within the direction control unit 50. A position command signal 52 is sent to the rudder dynamics unit 54. The rudder dynamics unit 54 contains the necessary elements to manipulate the position of the rudder 15 as well as a rudder position sensor 32 to provide rudder position signal 30 indicative of the rudder position. It will be appreciated that the directional command signal 34 could be dependent upon additional sensors and functions. For example, rudder force may also be sensed and employed to enhance control functions of the control-by-wire system 10. In an alternative embodiment a rudder force sensor 53 also located within rudder dynamics unit 54. The rudder force sensor 53 detects and also measures the forces/loads exerted in the direction control system 14 and sends a rudder force signal 55 representative of the measured forces to rudder control unit 50 and the master control unit 16 (FIG. 1). The rudder dynamics unit 54 includes hydraulic actuators, drive motors, and the like, which may be operated in either current or voltage mode, provided, in each case, sufficient stability margins are designed into the direction control system 14 with local loop (rudder control unit 50/rudder dynamics unit 54 loop) compensators. In an embodiment, a bandwidth greater than 3 Hz has been shown to be desirable in either case.

Similarly once again, it will further be appreciated that while particular sensors are enumerated to describe an exemplary embodiment, such sensors and nomenclature are described for illustration only and are not limiting. Numerous variations, substitutes, and equivalents will be apparent to those contemplating the disclosure herein. For example, while a rudder force sensor 53 and rudder position sensor 32 are described to sense the rudder force signals 55 and rudder position signal 30, such description is illustrative. Any sensor and nomenclature, which can be utilized to measure equivalent or similar parameters is also contemplated. Moreover, it will be appreciated that the rudder force sensor 53 may optional. For example, in the case of an alternative embodiment where the helm torque command is a function of position deviated from center of either the rudder 15 or of helm 20

Figure 3:
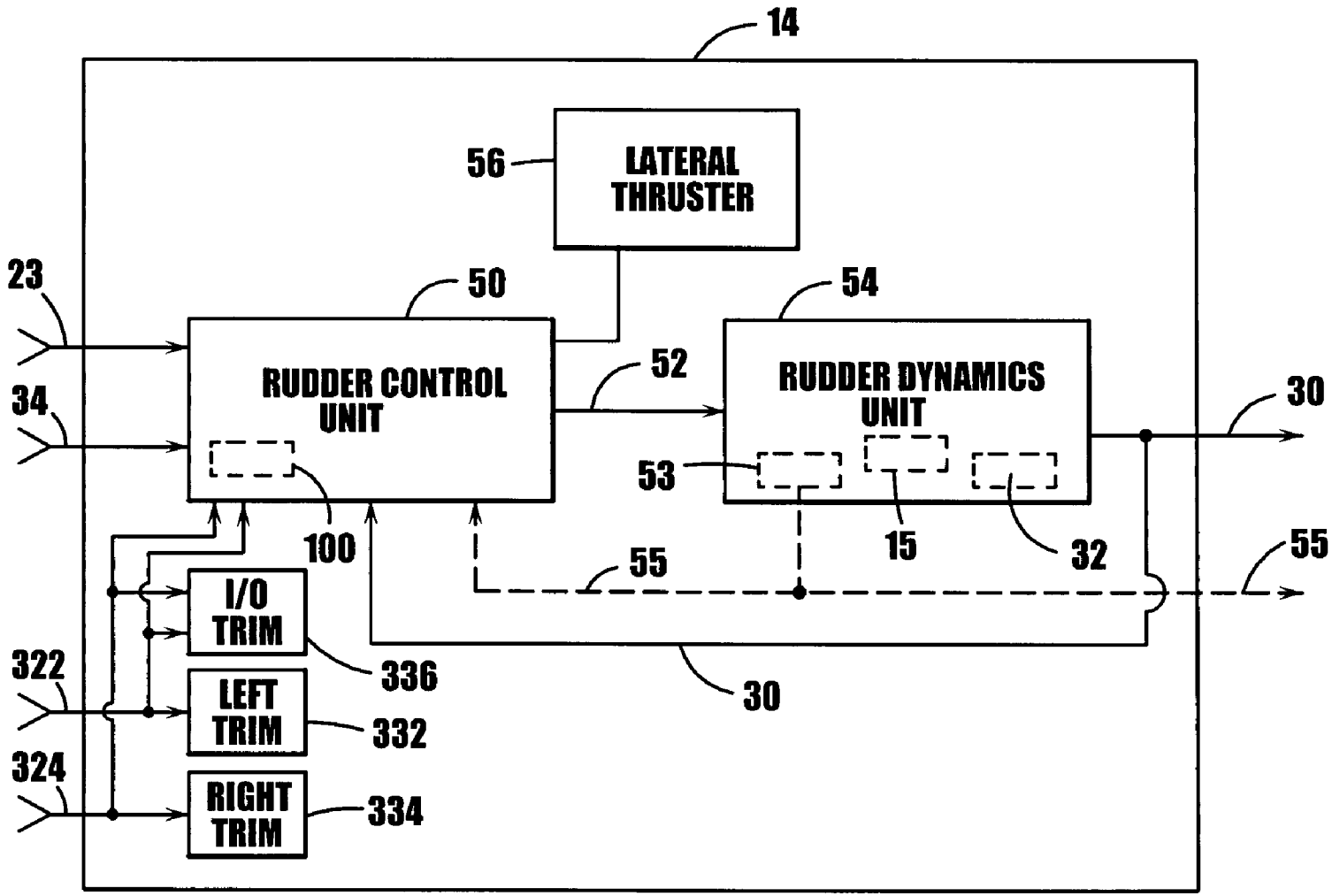
FIG. 3 is a block diagram of the direction control system of an exemplary embodiment as shown in FIG. 1.

Referring now to FIG. 3 as well, additional features for the steer-by-wire watercraft control system 10 may be considered in an exemplary embodiment adding one or more lateral thruster(s) 56 to the watercraft. The longitudinal (fore/aft) control of the watercraft could be controlled by the throttle position (not shown). For example, rudder 15 and/or outdrive directional control may be used in combination with lateral thruster(s) 56. For example, in a docking mode, in an exemplary embodiment, the steerable member, in this instance, the rudder 15 could be held in a fixed position, e.g., straight ahead, and the function of the helm 20 i.e. commanded inputs thereto, could change to a yaw type of control where yaw rotation/lateral motion is facilitated via lateral thruster(s) 56. Alternatively, the steerable member, in this instance rudder 15 could be configured to work in collaboratively with the lateral thruster(s) 56 to affect primarily lateral or yaw directional control. In this instance variable ratio control for the helm may be employed as disclosed herein to facilitate achieving the desired lateral/yaw control for a given motion of the helm 20.

In yet another exemplary embodiment, control of the lateral thruster(s) 56 is integrated with the steering control of the helm 20 and helm control system 12. The integrated steering control may be configured such that a lateral thruster(s) 56 operate under selected conditions to enhance steering with integrated lateral and yaw control of the watercraft. In an exemplary embodiment, the lateral thruster (s) 56 are configured to intermittently operate under the following conditions:

For a helm input of within a selected window of a number of degrees: 0% duty cycle i.e. hysteresis or a dead band; in an exemplary embodiment, twenty degrees is utilized;

For a helm control position exceeding a selected number of degrees: a duty cycle linearly increasing with helm position up to a travel stop, or a helm input is indexed into a look-up table for to facilitate employing a nonlinear duty cycle to the travel stops; in an exemplary embodiment, a window of five degrees is employed.

In yet another exemplary embodiment, the lateral thruster (s) 56 may be configured to operate with a helm input within a selected threshold of a travel stop. For example, within a selected number of degrees from an established helm travel stop.

It will be appreciated that because the steering response time of a vessel is relatively long, (in a controls system sense, in the area of about 10 seconds or more) the response duty cycle will also be relatively long to coincide with that of the watercraft.

The lateral thruster(s) 56 may also be configured to be responsive to other parameters. For example, in another exemplary embodiment, the lateral thruster(s) 56 operation varies as a function of a selected gear/drive e.g., forward, reverse, neutral, or as a function of mode, e.g., standard or non-docking (yaw control), transitional (combination of yaw and lateral control), docking lateral control.

In one exemplary embodiment, with a selected gear in the forward position and non-docking mode (yaw control) the lateral thruster(s) 56 are configured to operate in the direction of steering e.g., helm turned to the left (port) then lateral thruster operates to push the bow of the watercraft to the left (while the rudder 15 control provides thrust of the stem to the right). In other words, the lateral thruster(s) operates to provide thrust in the opposite direction of the rudder control (yaw control).

In a docking mode, the lateral thruster(s) (56) operate to direct the watercraft in particular the bow, in the same direction as the stem propulsion (lateral control). In an exemplary embodiment, the gear position/selection is employed to select the desired lateral thruster(s) 56 direction. It will be appreciated that other variations and combinations of rudder directional control/lateral thruster(s) 56 control are conceivable.

In yet another additional embodiment, expanded functionality may be achieved for lateral/yaw control of a watercraft by employing an additional control input such as a joy stick, or push buttons providing a directional signal command 21 as part of the helm 20 that would command lateral control of the directional control system 14 to generate a position command to the rudder 15 of the rudder dynamics unit 54 and a lateral thrust command 23 to the lateral thruster(s) 56, and thereby cause the rudder 15 to direct the watercraft to the left while the lateral thruster(s) 56 would provide thrust in the left direction, a control system would maintain close to zero yaw while the boat would travel in a lateral direction. For example, a joystick or push buttons could be utilized for yaw, & lateral/longitudinal directional control of the watercraft. Moreover, an additional lateral thruster 56 may be employed to facilitate pure lateral motion control, if some yawing motion is deemed undesirable.

On the other hand, while in a high-speed mode, the helm 20 control characteristics may be reconfigured to control the rudder 15 and directing drive thrust, with the lateral thruster (s) 56 disabled. In an exemplary embodiment, mode switching is automatic and transparent to the operator and is based on watercraft parameters, including but not limited to, speed of the craft and/or throttle position. In yet another exemplary embodiment, the lateral thruster(s) 56 discussed above could also be employed as an input approaches the above-mentioned stops. The input is the helm 20, the stops are adjustable as in the variable ratio case, and as the helm 20 approaches a selected position, e.g., approximately 5 degrees from a stop the lateral thruster 56 would be turned on. For example, in an exemplary embodiment, when the helm is turned to the left, the lateral thruster(s) 56 may be turned on to provide thrust to the right direction causing the bow of the watercraft to move left. Similarly, when the helm is turned to the right, the lateral thruster(s) 56 may be turned on to provide thrust to the left direction causing the bow of the watercraft to move right. It will be appreciated that one or more lateral thruster(s) 56 may be employed. For example, in an exemplary embodiment, two lateral thrusters 56 are employed including interlocks to prevent simultaneous operation. Moreover multiple lateral thruster(s) 56 may be employed, with variable directional thrust in multiple directions.

In yet another exemplary embodiment control of the water craft and mode selection may be implemented employing a simple switched input. In an embodiment, a watercraft mode selector 38 for producing a mode selection signal 39. For example, in one embodiment a switched input is used to select "yaw" control as opposed to "lateral" control. Moreover, a switched input from the helm may be employed to select other operating modes including a variable ratio helm command as described herein. Advantageously, this provides a rather simple implementation for selected control functions and features.

Figure 4:
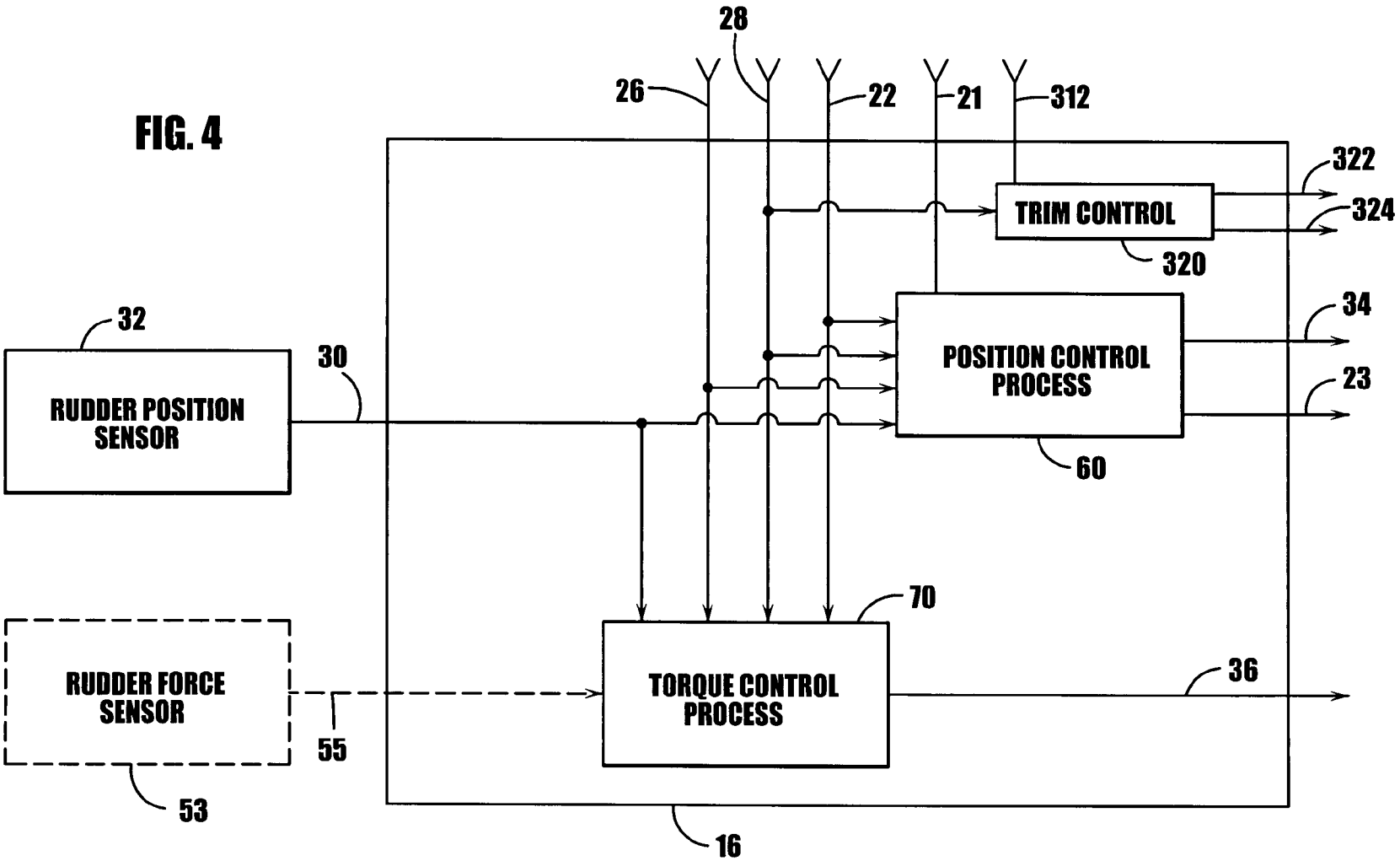
FIG. 4 is a block diagram of the master control unit shown in FIG. 1.

Continuing with FIGS. 1, 3, and 4, in yet another exemplary embodiment, an inclination system 300 comprising an inclination sensors 310*a*, in the fore and aft direction and 310*b* in the port and starboard direction may be utilized to measure tilt of the watercraft for instances where a load is not centered on the center of gravity or to control plane time and application. Control of inclination is facilitated by an additional control process for trim 320 in the master control unit 16, which generates a left and right trim command 322 and 324 respectively for I/O trim 336, (in the case of an I/O drive) and trim tab control. In an exemplary embodiment, these functions are optionally a function of watercraft speed to facilitate implementation. For example, trim control could be disabled at low speed. In the case of port/starboard control, a closed loop control integrated with port/starboard inclination sensors 310 transmit an inclination signal 312 to the master control unit 16. Process trim 320 in turn computes a trim commands 322, and 324 to direct the stern trim tabs 332 and 334 and/or I/O trim 336 for port and starboard respectively. The trim tabs 332 and 334 may be controlled out of phase from each other to control port starboard tilt. Similarly, for fore/aft control, a closed loop control integrated with the fore/aft inclination sensor 310 and the stern trim tabs 332 and 334.

Figure 8:
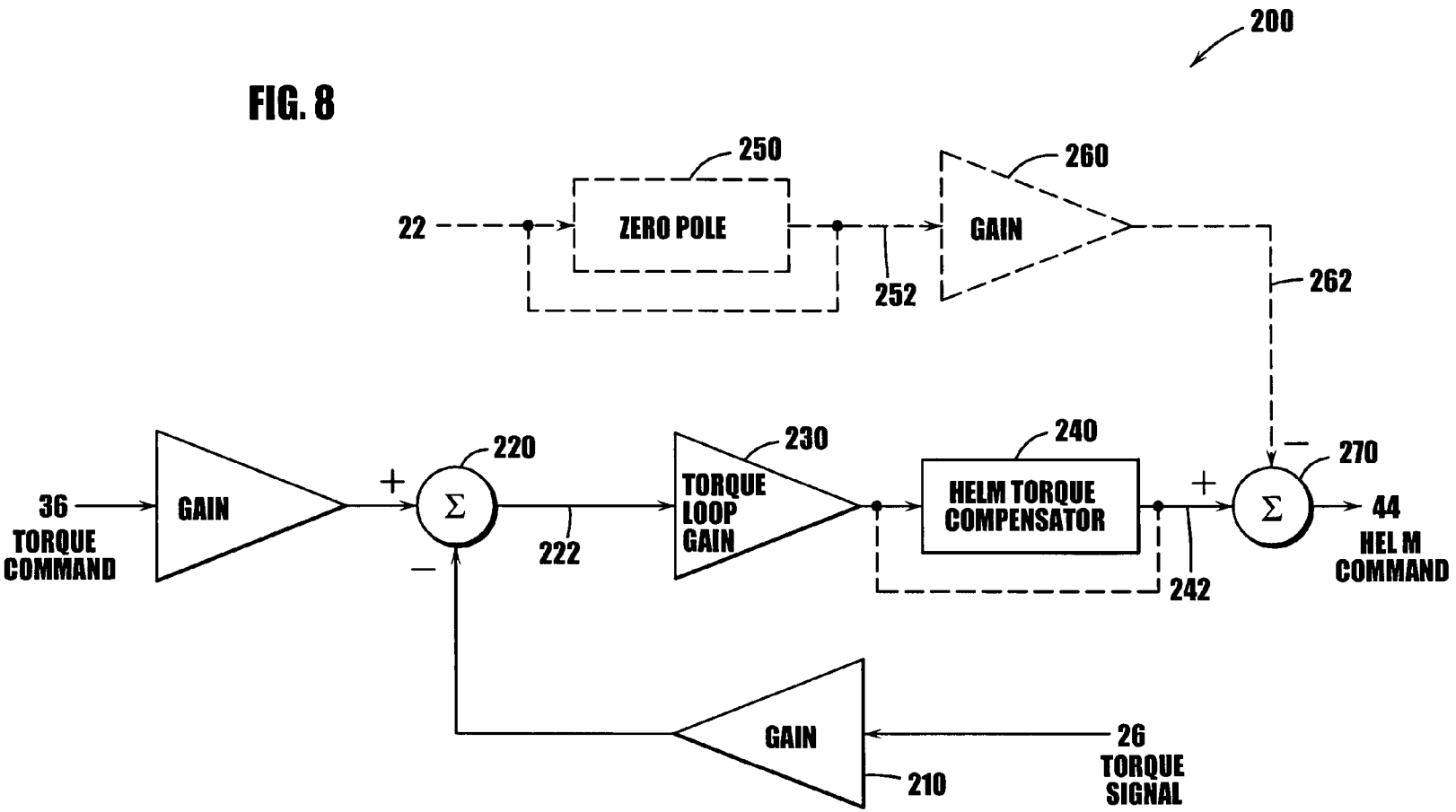
FIG. 8 is a block diagram depicting an implementation of a control algorithm for implementing an exemplary embodiment.

FIG. 4 shows a more detailed view of the master control unit 16 and particularly the processes executed therein. The master control unit 16 receives the helm position signal 22 and helm torque signal 26 from the helm control system 12. This helm position signal 22, the helm torque signal 26 and the watercraft speed signal 28 are utilized to generate and output the rudder directional command signal 34 within a position control process 60 of the master control unit 16. Moreover, the helm position signal 22, optional rudder force signal 55, helm torque signal 26 and watercraft speed signal 28 are utilized to generate and output the helm torque command signal 36 within a torque control process 70 of the master control unit 16. The torque control process 70 and position control process 60 form outer loop controls for the helm control system 12 and direction control system 14 respectively. The master control unit 16 as well as any controller functions may be distributed to the helm control system 12 and direction control system 14. The master control unit 16 is disposed in communication with the various systems and sensors of the control-by-wire system 10. Master control unit 16 (as well as the helm control unit 40 and rudder control unit 50) receives signals from system sensors, quantify the received information, and provides an output command signal(s) in response thereto, in this instance, for example, commands to the subsystems and to the helm dynamics unit 42 and rudder dynamics unit 54 respectively. As exemplified in the disclosed embodiments, and as depicted in FIGS. 2 and 8, one such process may be determining from various system measurements, parameters, and states the appropriate force feedback for compensating a helm control system 12, another may be determining from various system measurements, parameters, and states the appropriate position feedback for compensating a direction control system 14.

In order to perform the prescribed functions and desired processing, as well as the computations therefore (e.g., the control algorithm(s), and the like), the controllers e.g., 16, 40, 50 may include, but not be limited to, a processor(s), computer(s), memory, storage, register(s), timing, interrupt (s), communication interface(s), and input/output signal interfaces, and the like, as well as combinations comprising at least one of the foregoing. For example, master control unit 16 may include signal input signal filtering to enable accurate sampling and conversion or acquisitions of such signals from communications interfaces. Additional features of master control unit 16, the helm control unit 40, and rudder control unit 50 and certain processes therein are thoroughly discussed at a later point herein.

Master Control Processes

Figure 5:
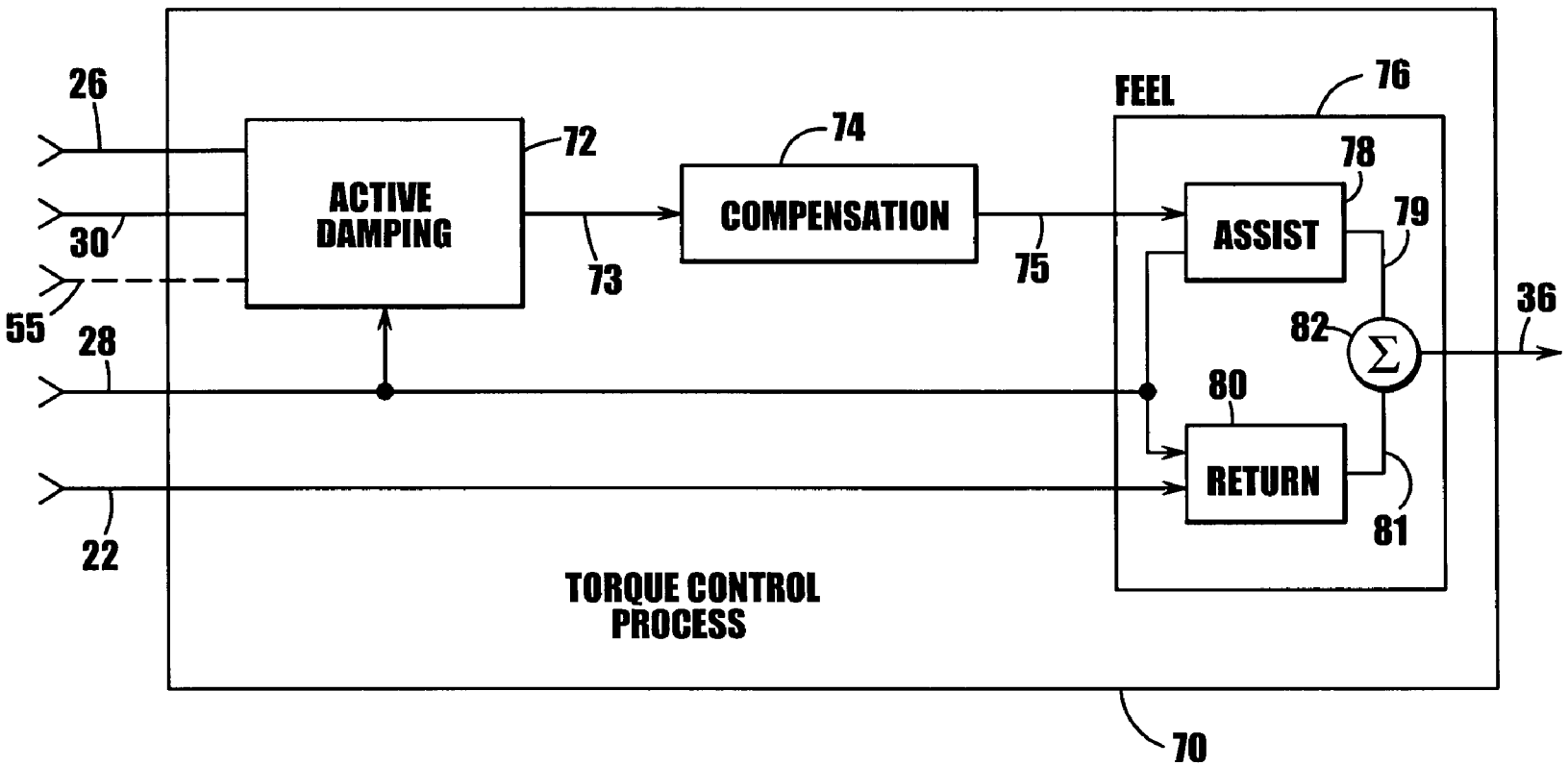
FIG. 5 is a block diagram of the torque control process shown in FIG. 4.

Referring to FIG. 5, the torque control process 70 performs several processes for generating the helm torque command signal 36. These processes include, but are not limited to an active damping process 72, compensation 74, and a feel process 76. These processes utilize as inputs; the rudder force signal 55, watercraft speed signal 28, the helm torque signal 26, and the helm position signal 22, to generate the helm torque command signal 18 as an output. The first process is the active damping process 72, which utilizes one or more of: the watercraft speed 28, the helm torque signal 26, and may employ the helm position signal 22, rudder force signal 55 (if utilized) in various combinations to generate a damping torque command signal 73. The active damping process 72 provides the opportunity to control the damping of the control-by-wire-system 10 dynamically as a function of watercraft operational parameters. It will be appreciated that active damping employed with a passive torque control in the helm control system 12 will be able to add damping. However, with an active torque control utilized in the helm control system 12, damping may be readily added or subtracted from the system. In an exemplary embodiment, the active damping process generates an increasing desired damping command signal with increasing watercraft speed as indicated by the watercraft speed signal 28, decreasing helm torque as detected by the feedback torque sensor signal 36, and increasing rate of change of helm position signal 20. A damping torque command signal 73 is sent to a compensation process 74 of the torque control process 70.

The compensation process 74 may include, but is not limited to, frequency based filtering to manipulate the spectral content of the damping torque command signal 73 to ensure control-by-wire overall system loop stability. Moreover, the compensation process 74 is configured to maintain system stability in the event the bandwidth of the control loops within the helm control system 12 or direction control system 14 decrease. Finally, the compensation process 74 manipulates the damping torque command signal 73 to modify the spectral content of sensed force feedback to the watercraft operator. The compensation process 74 outputs the compensated torque command signal 75 to the feel process 76. It will be appreciated that if passive torque control is used in the presence of non-linear plant dynamics compensation such as compensation process 74 may also be necessary. As stated earlier such compensation may include, but not be limited to, scaling, scheduling, frequency based manipulation, and the like of the damping torque command signal 73.

Continuing with FIG. 5, and moving now to the feel process 76, which includes several sub-processes for generating the helm torque command signal 36. The first sub-processes of one exemplary embodiment being the assist sub-process 78, which generates an assist torque command signal 79 as a function of watercraft speed and the rudder force signal (if rudder force is not used, the sub-process may be simplified or not employed). In an exemplary embodiment, the assist sub-process 78 indexes the rudder force signal initiated, compensated torque command signal 75 and watercraft speed signal into a set of one or more torque look-up tables (not shown) yielding an assist torque command signal 79. Alternatively, where more than one look-up table is used, the look-up table resultants are preferably blended based upon a ratio dependent upon the watercraft speed signal 28. For example, two lookup tables might be used, one for low speeds, and one for high speeds. As the watercraft speed signal 28 increases, the table for high speeds becomes increasingly dominant in the blend over the table for low speeds. Generally, it may be desirable for the assist process 78 to provide increasing assist torque as a function of watercraft speed increases. Assist forces may be formulated/evidenced as a decrease in the steering assisting force to allow the operator to feel more of the steering load or as in an exemplary embodiment, the commanded torque to the operator is increased to cause the operator to feel additional steering load at the helm 20. It will be appreciated that the assist function is optionally employed if the steering system is configured to detect the load of the direction control system 14. In the instance where position is utilized to provide a force (tactile feedback) to the operator the assist function is optional and not needed.

Another sub-process employed in the feel process 76 is the return sub-process 80. If an optional active torque control loop control is employed a return sub-process 80 may be utilized. The return sub-process 80 generates a return to center torque command 81 to drive the helm and the control-by-wire system 10 to neutral or center under particular operating conditions based upon the current helm position as indicated by the helm position signal 22 and the watercraft speed as indicated by the watercraft speed signal 28. Similar to the assist sub-process 78, the return sub-process 80 may employ one or more lookup tables, which, in this case, are indexed by the helm position signal 22. In an exemplary embodiment, the return sub-process 80 indexes the helm position signal 22 and watercraft speed signal 28 into a set of one or more lookup tables yielding a return to center torque command 81. Alternatively, where more than one look-up table is used, the look-up table resultants may be blended based upon a ratio dependent upon the watercraft speed signal 28. For example, two lookup tables might be used, one for low speeds, and one for high speeds. As the watercraft speed signal 28 increases, the table for high speeds becomes increasingly dominant in the blend over the table for low speeds. Generally, it may be desirable for the return sub-process 80 to provide increasing return torque as a function of watercraft speed increases. The final processing of the feel 76 process is to combine the assist torque command 79 (if generated) and the return to center torque command 81 (if generated) and thereby generating the helm torque command signal 36. In an embodiment, the combination is achieved via a summation at summer 82.

It should be appreciated that several embodiments are described some including additional sensor information and therefore additional processing function(s) e.g. rudder force. It should be further appreciated that an embodiment of the torque control process disclosed above could be as simple as braking, passive damping alone active damping 72 alone, an assist sub-process 78 alone, a return sub-process 80 alone, and the like as well as any combination including at least one of the foregoing.

Figure 6:
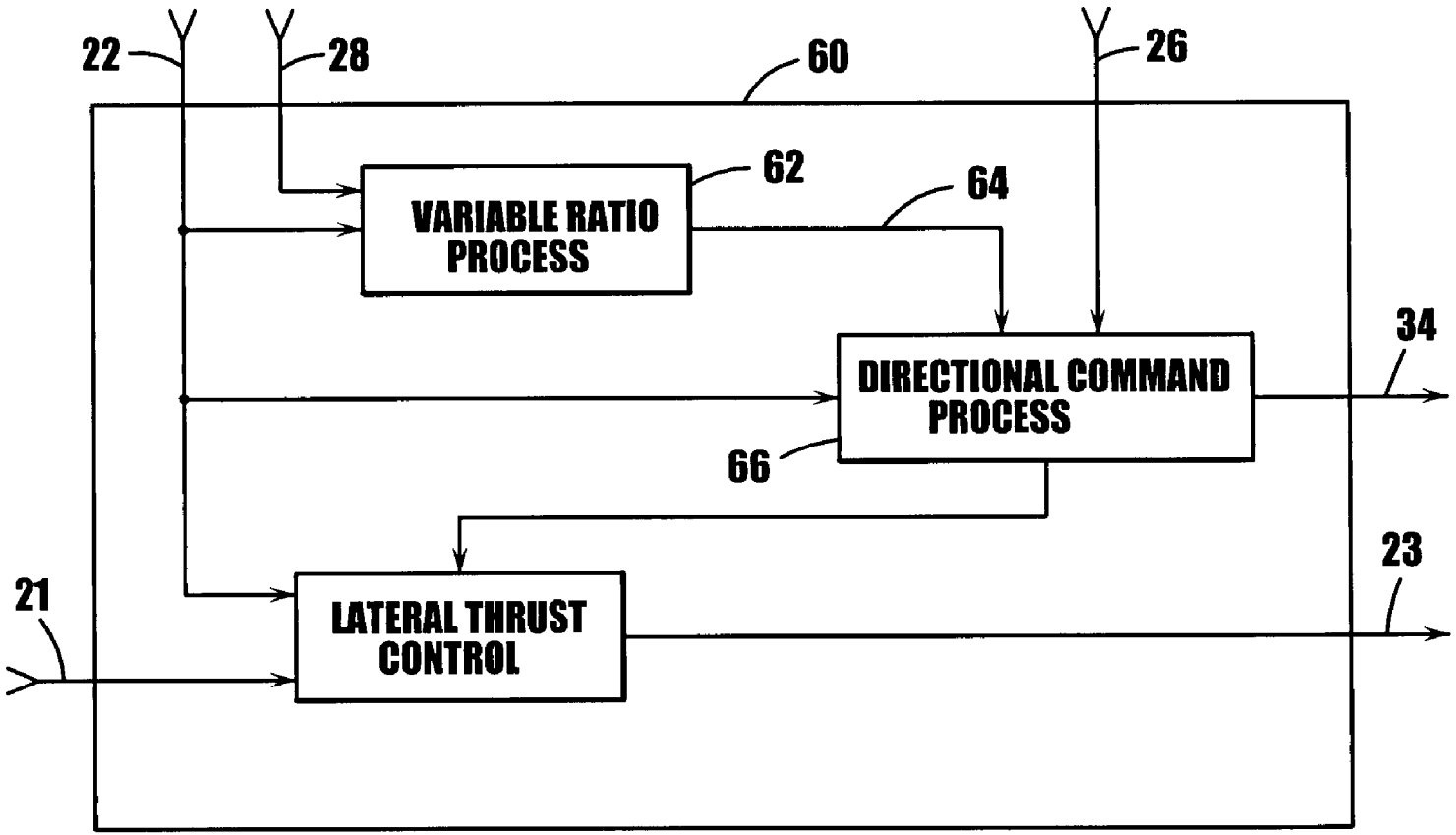
FIG. 6 is a block diagram of the position control process shown in FIG. 4.

Referring now to FIG. 6, the position control process 60 includes, but is not limited to several sub processes that are used in the calculation of the directional command signal 34. The position control unit 60 may include, but not be limited to, a variable ratio process 62, and a directional command process 66. In an exemplary embodiment, the variable steering ratio process 62 receives the helm position signal 22 and the watercraft speed signal 28. The helm position signal 22, and the watercraft speed signal 28 are used as inputs to a three dimensional look-up table to generate a variable steering ratio signal 64. The resulting variable steering ratio signal 64 is passed to the directional command process 66. In another exemplary embodiment, a variable ratio process 62 may be employed, which is further scheduled as a function of the helm position. For example, during the first few degrees of helm motion, the ratio may be greater than for other inputs. Since watercraft generally exhibit slow response especially at slow speeds, variable ratio as a function of helm position provides an advantage in handling and controllability by increasing the response of the watercraft to small inputs about center of helm position.

The directional command process 66 provides theta correction, that is, to correct the commanded rudder position to reflect the actual position of the helm 20 correctly. It may be appreciated that such a correction may only be needed for situations where the helm control system 12 includes a torque motor to provide a reaction torque to the operator in response to a movement of the rudder 15. However, the operator does not necessarily permit the helm 20 to turn (although he feels the reaction torque). The helm torque signal 26 provides an effective, relative position measurement under the abovementioned conditions. This relative position measurement is used by the directional command process 66 to account for the motor to helm difference and compensate the helm position signal 22 accordingly. The effect of the rudder 15 moving without the helm moving is undesirable so an angle correction is provided and a theta-corrected, directional command signal 34 is generated. It is noteworthy to further understand that theta correction is only needed if the helm position sensor 22 for the helm 20 is located such that a compliant member (t-bar or compliant torque sensor 24) in the actuator implementation of the helm dynamics unit 42 is between the helm position sensor 33 and at the helm 20.

It will be further appreciated that the correction identified above is a resultant of a selected implementation. In other implementations for an exemplary embodiment, such as where the helm control is simpler e.g., a brake for holding the helm 20 as opposed to a motor for providing reaction torque as described herein.

It is important to note that all the examples provided herein relate to a watercraft having a single steerable rudder 15. However, this type of system could be easily extended to a watercraft that requires one or more rudders to be steered independently and simultaneously by adding additional direction control units 14. Moreover, as previously discussed, in watercraft employing additional steerable members e.g. rudder, additional functionality may be implemented. For example, in an alternative embodiment, two or more steerable members may be employed to facilitate low speed maneuvering such as docking and the like. It is evident with multiple steerable members, a watercraft's thrust may be directed in multiple directions to facilitate yawing or lateral maneuvering.

Direction Control System

Figure 7:
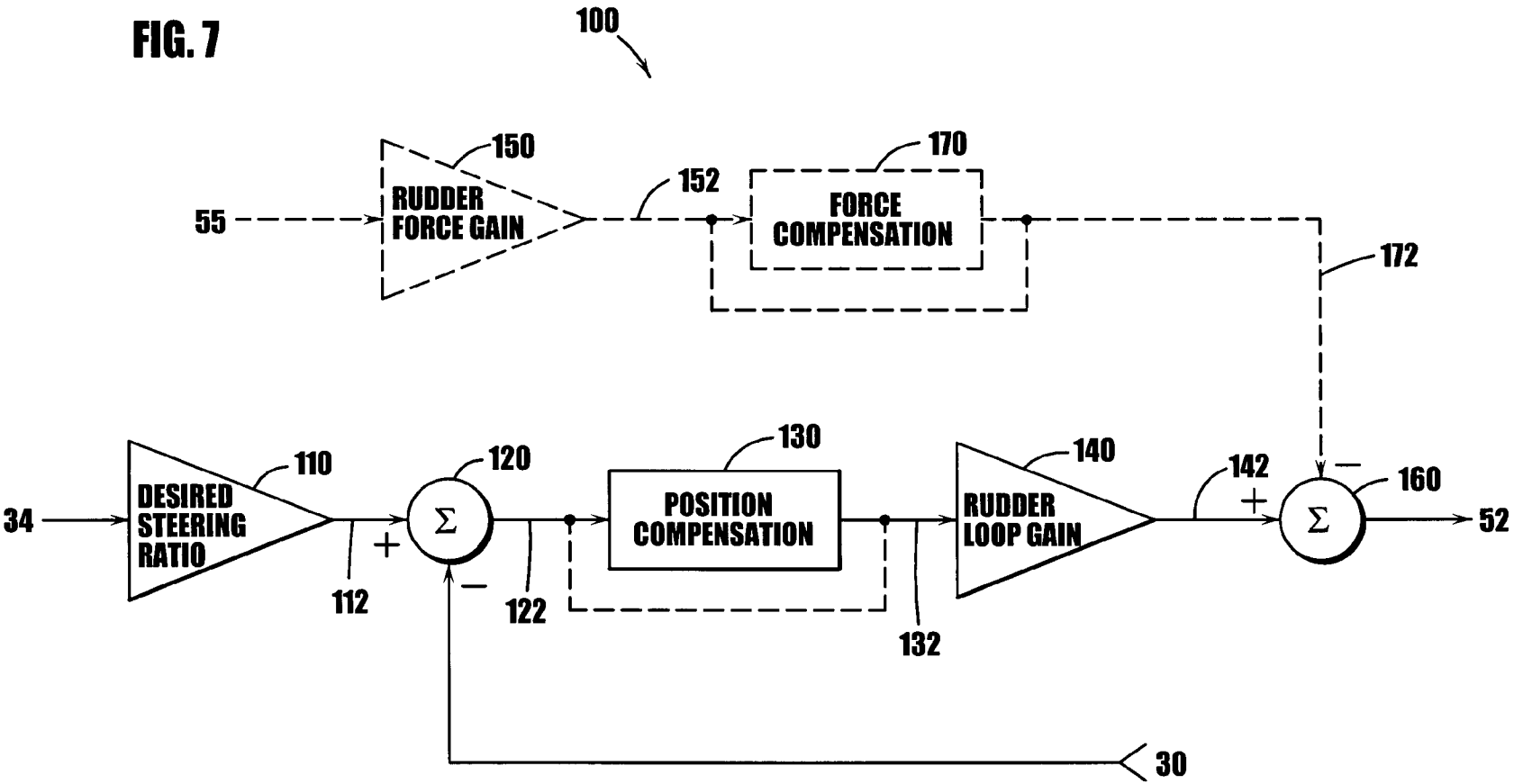
FIG. 7 is a block diagram depicting an implementation of a control algorithm for implementing an exemplary embodiment.

Referring now to FIGS. 3 and 7 depicting a simplified block diagram of a direction control system 14 in an exemplary embodiment of the position control implementation and specifically addressing the processing therein. The control functions implemented by the rudder control unit 50 (as discussed earlier as part of the direction control system 14) are used to control the rudder position of the steering system 10 via the rudder dynamics unit 54, (also discussed earlier). The position control functionality of the rudder control, optionally, may be augmented by force compensation, which is based on the load experienced by the plant, in the example herein, the rudder dynamics unit 54 or the direction control system 14.

FIG. 7 depicts a simplified diagram of an algorithm 100 that implements an exemplary process for rudder position control and optionally force compensation thereto. The rudder control unit 50 of the direction control system 14 performs several processes for generating the rudder position command signal 52. These processes utilize as inputs the directional command signal 34 and the helm position signal 22 to ultimately generate the rudder position command signal 52 as an output. In FIG. 7, the directional command signal 34 is scaled by a selected variable ratio at gain 110 to formulate a desired rudder position signal 112. The desired rudder position signal 112 is compared with the actual rudder position as indicated by the rudder position signal 30 at summer 120 to generate a rudder position error 122. The rudder position error 122, may, optionally, be applied to a position compensation process 130 to formulate a compensated rudder position command 132, which may then once again be scaled at gain 140 to formulate a rudder position command signal 142 which may be output as the rudder position command signal 52. In an alternative embodiment, the rudder force 55 may be scheduled or scaled at gain 150 to formulate a force compensation signal 152. The force compensation signal 152, may, optionally, be applied to a force compensation process 170 to formulate a compensated force signal 172, which may then once again be scaled if necessary. The compensated force signal 172 may be combined with the position command signal 142 at summer 160 to formulate a force compensated rudder position command signal 52 and thereafter applied to the rudder plant dynamics unit 54.

The position compensation process 130 includes, but is not limited to, frequency based filtering to manipulate the spectral content of the compensated rudder position command signal 132 to ensure direction control system 14, loop stability. Similarly, the force compensation process 170 includes, but is not limited to, frequency based filtering to manipulate the spectral content of the force compensation signal 172 to ensure direction control system 14, loop stability. Finally, for an alternative embodiment, the combination of the rudder position command signal 142 and the force compensated signal 172 operate in conjunction to modify the spectral content of sensed force feedback and position and ensure direction control system 14, loop stability. It should also be noted that the figures herein may depict additional and optional elements, connections, interconnections and the like. It will be appreciated that such configurations are commonly employed for implementation of a selected control configuration. For example, transport delays may be employed to ensure that data time coherency is addressed. Likewise, scaling may be employed to address unit conversions and the like.

A benefit of the alternative embodiment for algorithm control process 100 is that the addition of force compensation has a stabilizing effect on the direction control system 14. This effect is beneficial in that the load (force) feedback in position control exhibits a dampening effect on the system. Therefore, a desired gain margin may readily be achieved via a conventional position control. Advantageously, this allows the conventional control to focus on providing enhanced performance under varying conditions. Yet, another way of looking at the stability enhancements to the direction control system 14 is improvement in the free control oscillations. A more stable system would damp out such oscillations more rapidly than a less stable system. The addition of force feedback in the position control coupled with other control system tuning reduces the tendency of the system to exhibit free control oscillations.

Another benefit is that the alternative embodiment of control process 100 including force compensation is that it preserves the desired dynamic behavior of the closed loop rudder system under varying loads. When a steering load is applied and both embodiments are optimized for this load, both will exhibit comparable performance. However, when the load is lowered, (e.g., low speed, rudder centered) degradation in the performance of the embodiment with position control alone results. However, there is no degradation in the performance the control system when the alternative embodiment is employed. Similarly, when the load is raised (e.g., high speed, turning,) once again, degradation in the performance of the position control is observed while there is no degradation in the performance of the control system when the alternative embodiment is employed. This effect is beneficial in that the load (force) feedback exhibits a robustness enhancement on the system.

Another significant advantage realized by an alternative embodiment employing force feedback in a position control function for the direction control system 14 is that it does not negatively impact the system bandwidth as significantly as a pure rate based damping might. It is well known, that rate based damping may be employed in a typical control loop to maintain stability. In an exemplary embodiment and as applied to a watercraft steering system as disclosed here, system bandwidth has a significant impact on the steering feel at the helm. A higher bandwidth position control system/loop exhibits an ability to closely follow operator applied input and as a result generate the expected effort (load) as feedback. Conversely, a system lacking sufficient bandwidth may lag behind an applied input, resulting in undesirable response or worse, instability. Input impedance is a way of characterizing or observing the feel of the control-by-wire system 10. The effect of reducing the bandwidth (from about ten Hertz to about one Hertz) of the position control system/loop on the overall input impedance.

Helm Control System

Another embodiment of the invention described herein addresses the abovementioned issues of tactile feedback and stability by using information about helm position to directly influence the torque felt by the driver. By using a properly shaped transfer function, the input impedance of the steering system can be manipulated over a wide range of operating characteristics to obtain the desired feel. Including helm position in determination of the torque felt by the operator provides the desirable coupling between helm position and helm torque. However, beyond the fixed coupling that a mechanical connection provides, this approach provides a tunable coupling that can be adjusted based upon operator preferences, system characteristics, or operating conditions to achieve the desired steering feel for the watercraft overall.

This approach results in helm position and the resulting torque felt by the operator being largely decoupled. From a helm feel perspective, it will be appreciated that there is a desirable phase relationship between helm angular position and helm response torque. This desirable phase relationship is not fixed (as would be the case with a mechanically linked system) and may actually not be always be achievable depending upon the parameters sensed to provide the torque feedback to the helm. Moreover, there is also a desirable torque magnitude felt by the operator (as a function of input frequency). As the magnitude of this desired torque increases, the potential for undesirable response and even instability increases especially if the helm is released. This results from the feedback torque provided by the motor to achieve the desired feel is being balanced (in off-center and steady state sense) with the operator's effort. Once the operator releases the helm, however, the torque provided by the motor accelerates the helm to center and possibly overshoots, depending on the magnitude of the initial torque. As this overshooting action is taking place, the hand wheel system sends the corresponding position signal to the rudders, and the rudders return to center. However, due to lack of resistance by the operator (and thus a helm overshoot,) the rudder 15 may overshoot, as well. Therefore, the rudder forces under such a condition switch direction, and thus, there again, the helm dynamics unit 54 motor switches the direction of its torque (in response to the sensed rudder force). This causes the helm to drive back toward center (from the opposite off-center position now), and an overshoot of center may take place, again. The overshoot and oscillations is known in the art as "free control oscillation". Since these oscillations are due in part to lack of resistance by the operator, it is reasonable to add some kind of resistance or damping in the helm control system to address this phenomenon.

The addition of resistance may be sufficient for many applications, especially, where the load on the system has a predictable relationship to the system position (rotational or translational). In control system terms, this could be predicted by the location of the poles and zeros of the system or frequency response. A conventional control system could then be designed based on these dynamics.

However, in many systems, the load varies based on operating conditions even with the position and its derivatives kept the same. For example, in steering applications, the load on the steering system changes as a function of operation (lateral acceleration, watercraft speed etc) and watercraft properties. In such cases, the conventional control design is optimal for a given operating condition, but has reduced performance as the conditions change. Therefore, is may be advantageous to provide a control-by-wire system, which addresses the load on the system while still providing the assist forces and tactile feedback for the operator and reducing free control oscillation.

Referring once again to FIGS. 1 and 2, as disclosed earlier, the helm control system 12 is optionally a closed loop control system that optionally utilizes helm torque as the feedback signal. A helm torque command signal 36 optionally responsive to the rudder force signal 55 as detected by rudder force sensor 53 and/or a rudder position signal 30 as detected by rudder position sensor 32 may be received from the master control unit 16 into the helm control unit 40 where the signal is compared to the helm torque signal 26.

Continuing with FIG. 2, in addition the abovementioned torque feed back, an additional compensation path may be added to the helm control unit 40 of the helm control system 12 to incorporate position feedback in the torque control loop (e.g., position feedback in a force control loop) of the helm control system 12. The addition of the helm position signal 22 as feedback to the torque control functions provided by the helm control unit 40, enhances operation of the torque control functions therein. An optional position compensation process compensates the helm position feedback for combination with the compensated torque command signal 44. A position compensated torque command signal 44 is then passed to the helm dynamics unit 42 as needed to comply with the helm torque command signal 36. The position compensated helm torque command 44 determines the helm torque felt by the operator as generated by the helm dynamics unit 42. This results in a direct relationship between helm position and helm torque, which can be tuned to get the desired helm steering feel to the operator.

Turning now to FIG. 8 as well, a simplified block diagram depicting an implementation of a control algorithm 200 executed by a controller, e.g., the helm control unit 40. Control algorithm 200 includes, but is not limited to, a torque control path. In an exemplary embodiment, the torque control path comprises the helm torque signal 26, which is scaled at gain 210 and then combined with a scaled version of the helm torque command signal 36 at summer 220 to formulate a torque error signal 222. The torque error signal 222 may be scaled for example, at gain 230 and then optionally (as indicated by the dashed line in the figure) applied to an optional compensation process 240 to formulate the compensated torque command 242 the compensated torque command 242 may be output directly as the helm torque command 44.

In an alternative embodiment, the torque control path of the control algorithm 200 may be further supplemented with a position path. In the position path, the helm position signal 22 is coupled into the helm motor current command 44. The helm position signal 22 is optionally (once again, as indicated by the dashed line in the figure) applied to an optional compensation process 250 to formulate a compensated helm position signal 252 and thereafter scaled at gain 260. The scaling at gain 260 yields a position compensation signal 262 for combination with the existing compensated torque command signal 242. It is noteworthy to appreciate that this position compensation signal 262 is analogous to the force feedback discussed above in implementations of the direction control unit 50. The combination of the compensated torque command signal 242 with the position compensation signal 262 depicted at summer 270 yields a position compensated torque command to the helm plant dynamics unit 42. The combination of the compensated torque command signal 242 with the position compensation signal 262 operates in conjunction to modify the spectral content of helm torque feedback to the watercraft operator and ensure helm control system 12 loop stability.

The compensation processes 250 and 240 include, but are not limited to, frequency based filtering to manipulate the spectral content of the compensated helm position signal 252 and compensated torque command signal 242 respectively. The frequency-based compensators 240 and 250 cooperate in the helm control unit 14 to maintain stability of the helm dynamics unit 42. Therefore, by configuration of the compensation processes 240 and 250 the characteristics of the helm control system 14 may be manipulated to provide desirable responses and maintain stability. In an exemplary embodiment, the compensation processes 240 and 250 are configured to provide stability of the helm system 14 at sufficient gains to achieve bandwidth greater than 3 Hz.

Once again, it should be noted that FIG. 8 depicts additional elements, connections, interconnections and the like. It will be appreciated that such configurations are commonly employed for implementation of a selected control configuration. For example, transport delays may be employed to ensure that date time coherency is addressed. Likewise, scaling may be employed to address unit conversions and the like.

A benefit of the alternative embodiment for control process 200 is that the addition of position compensation has a stabilizing effect on the helm control system 12. This effect is beneficial in that the position input in torque control exhibits a dampening effect on the system. Therefore, a desired gain margin may readily be achieved via a conventional torque control. Advantageously, this allows the conventional control to focus on providing enhanced performance under varying conditions. Yet, another way of looking at the stability enhancements to the helm control system 12 is improvement in the free control oscillations. A more stable system would damp out such oscillations more rapidly than a less stable system. The addition of position feedback in the torque control coupled with other control system tuning reduces the tendency of the system to exhibit free control oscillations.

Another benefit is that the alternative embodiment of control process 200 including position compensation is that it preserves the desired dynamic behavior of the closed loop helm system 12 under varying positions. When a steering position is modified and both embodiments are optimized for this position, both will exhibit comparable performance. However, when the position is modified degradation in the performance of the embodiment with torque control alone results. However, there is no degradation in the performance of the control system when the alternative embodiment is employed. This effect is beneficial in that the position input results in a robustness enhancement on the system not achieved with the torque control alone.

Another significant advantage realized by employing position input in a torque control function for the helm control system 12 is that it does not negatively impact the system bandwidth as significantly as a pure rate based damping might. It is well known, that rate based damping may be employed in a typical control loop to maintain stability. In an exemplary embodiment and as applied to a watercraft steering system as disclosed here, system bandwidth has a significant impact on the steering feel at the helm. A higher bandwidth torque control system/loop exhibits an ability to closely follow operator applied input and as a result, generate the expected feedback. Conversely, a system lacking sufficient bandwidth may lag behind an applied input, resulting in undesirable response or worse, instability. Input impedance is one way of characterizing or observing the feel of the control-by-wire system 10. The effect of reducing the bandwidth (for example, from about ten Hertz to about one Hertz) of the control system/loop will result in phase lag, loss of robustness and less desirable feel characteristics to an operator.

It will be appreciated that while the disclosed embodiments refer to a configuration utilizing scaling in implementation, various alternatives will be apparent. It is well known that such gain amplifiers depicted may be implemented employing numerous variations, configurations, and topologies for flexibility. For example, the processes described above could employ in addition to or in lieu of scaling gains, look-up tables, direct algorithms, parameter scheduling or various other methodologies, which may facilitate execution of the desired functions, and the like, as well as combinations including at least one of the foregoing. In a similar manner, it will be appreciated that the compensation processes such as 74, 130, 170, 240, and 250 may be implemented employing a variety of methods including but not limited to passive, active, discrete, digital, and the like, as well as combinations including at least one of the foregoing. More over the compensation processes 74, 130, 170, 240, and 250 as disclosed are illustrative of an exemplary embodiment and is not limiting as to the scope of what may be employed. It should be evident that such compensation processes could also take the form of simple scaling, scheduling look-up tables and the like as desired to tailor the content or spectral content of signals employed as compensation. Such configuration would depend on the constraints of a particular control system and the level of compensation required to maintain stability and/or achieve the desired control loop response characteristics. Finally, it will be evident that there exist numerous numerical methodologies in the art for implementation of mathematical functions, in particular as referenced here, derivatives. While many possible implementations exist, a particular method of implementation should not be considered limiting.

From a steering feel perspective, input impedance indicates the relationship between helm angle applied by a driver and helm torque felt in response. This relationship may be quantified by means of consideration of the frequency response characteristics of the helm control system 12. For a steering system where the steering input (e.g., helm, steering wheel, and the like) has a mechanical linkage to the rudder 15, it may be sufficient to consider the magnitude response only, as the mechanical linkage maintains a fixed phase relationship with the steering input. In such a situation, achieving an appropriate magnitude response characteristic guarantees an equivalent phase response characteristic.

For other steering systems (e.g., without such a mechanical linkage, such as steer-by-wire, control-by-wire, and the like), a fixed phase relationship is not guaranteed by a fixed linkage. Therefore, such systems may potentially exhibit an undesirable phase relationship even though the magnitude response appears appropriate. For example, in the case of a watercraft and the embodiments disclosed herein, such systems may introduce a lag between helm input and the rudder 15 responses. Thus, consideration of both the magnitude response and phase response of the input impedance may be important for steering systems that do not exhibit a fixed phase relationship.

It is also noteworthy to appreciate that increasing the bandwidth of the helm control system 12, direction control system 14, or overall steer-by-wire system 10 also improves input impedance. As a result, a compensator such as compensation processes 74, 130, 170, 240, and 250 may designed that increases the bandwidth of the helm control system 12, direction control system 14, and/or the entire control-by-wire system 10 and also changes the dynamic characteristics of the input impedance. Once again, bandwidth increases in one part of the control-by-wire system 10 may provide for improved performance and/or relaxed requirements for other portions of the system. It should be evident that it is desirable to increase bandwidth in both the direction control system 14 as well as the helm control system 12. As stated earlier, both direction control system 14 and helm control system 12 loop bandwidths are important; if either is too low, it will result in undesirable performance.

Moreover, modifying the bandwidth of the helm dynamics unit 42 (actuator) and the rudder dynamics unit 54 (actuator) may also be impact the input impedance of the control-by-wire system 10. Therefore, the input impedance dynamic response, and specifically the phase response may vary by increasing the bandwidth of the helm dynamics unit 42 (actuator) and/or the rudder dynamics unit 54 (actuator). However, achieving a desirable input impedance and specifically, in the phase response, with bandwidth improvements alone may be expensive and moreover, may result in other undesirable effects. By employing the exemplary embodiments disclosed herein; the feeding helm position information into the helm torque control loop, and feeding force into the rudder position control loop, additional improvements can be achieved beyond those provided by bandwidth increases alone, and it may be possible to achieve acceptable performance at a lower bandwidth. As a result, using this approach may actually reduce costs without impacting performance of the control-by-wire system 10.

Yet, another noteworthy consideration is the selection of signals or parameters to be employed for the feedback. For example, for position feedback, the subject signals/parameters are helm position, rudder position, and helm motor position e.g., position of the motor within the helm dynamics unit 42. Comparison of input impedance dynamic response for the system using these three signals/parameters may yield significantly different results. For example, all three signals can result in similar input impedance characteristics, yet each exhibit significantly different results for disturbance rejection. In a particular implementation, the difference between helm motor position when compared to helm position may be attributed to the compliance of the torque sensor 24. This compliance will effectively attenuate the high frequency signals transmitted to and measured at the helm. It is evident that having information directly from the motor would help in reducing the impact of motor disturbances because it is the information in closest proximity to the source of the disturbance and facilitates correction to be applied prior to transmission to the steering wheel. Given that helm motor position gives better resolution than using helm position and resulted in better disturbance rejection, in an exemplary embodiment, motor position was selected as the preferred signal/parameter for feedback, although other position signals could be utilized.

Yet, another enhancement achievable with implementation of the embodiments disclosed herein are improvements in control-by-wire system performance related to error tracking. For the exemplary embodiments disclosed, as bandwidth of the direction control system 14 or helm control system 12 is increased, an improvement in tracking the commanded input is evidenced. Such an improvement is further evidenced as improved tracking of the overall system. In other words, for a given input; the direction control system 14, helm control system 12, and over all control-by-wire system 10 will follow or track that input more accurately. Reductions in tracking errors correspond to reductions in system errors and improvements in overall performance. Once again, improvements achieved by such an increase in bandwidth, resulting in an improvement in tracking error my permit reductions in requirements for other components and thereby, reductions in cost. For example, if tracking error is improved, a lower cost less accurate sensor may prove acceptable without impacting performance. Moreover, it will be appreciated that there are numerous advantages and improvements resultant from the bandwidth enhancements disclosed herein for a control system that are well known and now readily achievable.

The disclosed invention may be embodied in the form of computer-implemented processes and apparatuses for practicing those processes. The present invention can also be embodied in the form of computer program code containing instructions embodied in tangible storage media 33, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage media 33, loaded into and/or executed by a computer, or as data signal 35 transmitted whether a modulated carrier wave or not, over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

What is claimed is:

1. A watercraft steer-by-wire control system comprising:

a direction control system responsive to a directional command signal for steering a watercraft, said direction control system including a rudder position sensor to measure and transmit a rudder position signal;

a helm control system responsive to a helm command signal for receiving a directional input to a helm from an operator and providing tactile feedback to an operator, said helm control system including at least one of a helm position sensor to produce and transmit a helm position signal and a torque sensor to produce and transmit a helm torque signal, said tactile feedback including at least one of: a resistive force, a reaction torque to an operator; an on center detent as a helm moves thru a center position; and variable control stops to resist helm motion beyond a selected threshold;

a watercraft speed sensor for producing a watercraft speed signal;

a master control unit in operable communication with said watercraft speed sensor, said helm control system, and said direction control system;

said master control unit includes a position control process for generating said directional command signal in response to said watercraft speed signal, said helm torque signal and said helm position signal;

said master control unit includes a torque control process for generating said helm command signal based on said helm torque signal, said helm position signal and said watercraft speed signal; and a lateral thruster in operable communication and cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

2. The watercraft steer-by-wire control system of claim 1 further including a rudder force sensor in operable communication with said direction control system to produce and transmit a rudder force signal and wherein at least one of said direction control system and said torque control process is responsive to said rudder force signal.

3. The watercraft steer-by-wire control system of claim 1 wherein said torque control process includes an active damping process wherein a damping torque command signal is generated based on a time rate of change of said helm position signal and modified by said helm torque signal and said watercraft speed signal.

4. The watercraft steer-by-wire control system of claim 1 wherein said torque control process implements a compensator to configure spectral content of a damping torque command signal thereby generating a compensated torque command signal, said compensator is configured to facilitate at least one of a modification of the spectral content of said tactile feedback and maintaining stability of said watercraft steer-by-wire control system.

5. The watercraft steer-by-wire control system of claim 1 wherein said torque control process further implements a feel process comprising an assist sub-process responsive to a compensated torque command signal and said watercraft speed signal, which generates an assist torque command and a return sub-process responsive to said helm position signal and said watercraft speed signal, which generates a return torque command.

6. The watercraft steer-by-wire control system of claim 1 wherein said position control process calculates and produces a variable steering ratio signal in response to said helm position signal, said helm torque signal, and said watercraft speed signal.

7. The watercraft steer-by-wire control system of claim 1 wherein said position control process further comprises a directional command process that calculates a theta correction and generates a theta corrected directional command signal from a variable steering ratio signal, said helm torque signal, and said helm position signal.

8. The watercraft steer-by-wire control system of claim 1 wherein said helm control system comprises a closed loop control system responsive to said helm command signal and said helm torque signal.

9. The watercraft steer-by-wire control system of claim 1 wherein said helm control system configured to exhibit a bandwidth sufficient to facilitate said torque control process maintaining stability of said watercraft steer-by-wire system.

10. The watercraft steer-by-wire control system of claim 1 wherein said helm control system comprises a helm control unit and a helm dynamics unit; said helm control unit is responsive to said helm command signal and said helm torque sensor signal and generates a torque command signal; said helm dynamics unit is responsive to said torque command signal and provides said tactile feedback in response thereto to an operator.

11. The watercraft steer-by-wire control system of claim 10 wherein said helm control unit includes a compensator configured to characterize spectral content of said torque command signal to facilitate at least one of maintaining stability of said helm control system and increasing bandwidth of said helm control system.

12. The watercraft steer-by-wire control system of claim 1 wherein said direction control system is configured to exhibit a bandwidth sufficient to facilitate said position control process maintaining stability of said watercraft steer-by-wire system.

13. The watercraft steer-by-wire control system of claim 1 wherein said direction control system comprises a closed loop control system responsive to said directional command signal and said rudder position signal.

14. The watercraft steer-by-wire control system of claim 1 wherein said direction control system comprises a rudder control unit and a rudder dynamics unit; said rudder control unit is responsive to said directional command signal and a rudder position signal and generates a position command signal; said rudder dynamics unit is responsive to said position command signal and provides a rudder position in response thereto.

15. The watercraft steer-by-wire control system of claim 14 wherein said rudder control unit includes a compensator configured to characterize spectral content of said position command signal to facilitate at least one of maintaining stability of said direction control system and increasing bandwidth of said direction control system.

16. The watercraft steer-by-wire control system of claim 1 further including an inclination control system comprising:

an inclination sensor in operable communication with said master control unit;

at least one of an I/O trim and a trim tab, with an actuator in operable communication with said master control unit; and wherein said master control unit provides a trim command to said trim tab to control watercraft inclination.

17. The watercraft steer-by-wire control system of claim 16 wherein said trim tab comprises a port trim tab and starboard trim tab to facilitate lateral inclination control.

18. A method for directing a watercraft with a watercraft steer-by-wire system comprising:

receiving a watercraft speed signal;

receiving a helm position signal;

receiving a helm torque sensor signal;

receiving a rudder position signal;

generating a helm command signal to a helm control system based on said helm torque signal, said helm position signal, and said watercraft speed signal to provide tactile feedback to an operator, said tactile feedback including at least one of: a resitive force, a reaction force to an operator; an on center detent as a helm control moves thru a center position; and variable control stops to resist helm motion beyond a selected threshold;

generating a directional command signal to a direction control system based on said watercraft speed signal, said rudder position signal, and said helm position signal to control direction of said watercraft; and commanding a lateral thruster in cooperation with a rudder dynamics unit directing thrust to provide at least one of sustantially lateral control and substantially yaw control to facilitate at least one of low speed and docking operations; wherein said lateral thruster is responsive to at least one of a port command and a starboard command.

19. The method for steering a watercraft of claim 18 further comprising:

receiving a rudder force signal and wherein said a helm command signal is also based on said rudder force signal; and generating a directional command signal to a direction control system based on said watercraft speed signal, said helm position signal, and at least one of said rudder position signal and said rudder force signal.

20. The method for steering a watercraft of claim 18 further comprising:

generating damping torque command signal responsive to said helm torque signal, said helm position signal and said watercraft speed signal; wherein said damping torque command signal is responsive to a time rate of change of said helm position signal.

21. The method for steering a watercraft of claim 20 further comprising compensating said damping torque command signal to configure spectral content of said damping torque command signal and thereby, generating a compensated torque command signal, wherein said compensating includes filtering configured facilitate at least one of tailoring said tactile feedback, maintaining stability of said steer-by-wire system.

22. The method for steering a watercraft of claim 21 wherein said helm command signal is responsive to a combination of an assist torque command and a return torque command, and wherein said assist torque command is responsive to said compensated torque command signal and said watercraft speed signal; and said return torque command is responsive to said helm position signal and said watercraft speed signal.

23. The method for steering a watercraft of claim 18 further comprising calculating and producing a variable steering ratio signal in response to said helm position signal and said watercraft speed signal.

24. The method for steering a watercraft of claim 23 wherein said generating said directional command signal is based on said helm position signal, said helm torque signal, and said variable steering ratio signal.

25. The method for steering a watercraft of claim 18 further including generating a torque command signal in a helm control system such that said helm control system exhibits a bandwidth sufficient to facilitate a torque control process generating said helm command signal to facilitate maintaining stability of said steering.

26. The method for steering a watercraft of claim 18 wherein said helm control system comprises a helm control unit and a helm dynamics unit, said helm control unit is responsive to said helm torque command signal and said helm torque signal and generates a torque command signal, said helm dynamics unit is responsive to said torque command signal and provides a reaction torque in response thereto to an operator.

27. The method for steering a watercraft of claim 26 wherein said helm control unit includes a compensator configured to characterize spectral content of said torque command signal to facilitate at least one of maintaining stability of said helm control system and increasing bandwidth of said helm control system.

28. The method for steering a watercraft of claim 18 further including generating a position command signal in a direction control system such that said direction control system exhibits a bandwidth sufficient to facilitate a position control process generating said rudder command signal to facilitate maintaining stability of said steering.

29. The method for steering a watercraft of claim 28 wherein said direction control system comprises a rudder control unit and a rudder dynamics unit, said rudder control unit is responsive to said directional command signal and said rudder position signal and generates a position command signal; said rudder dynamics unit is responsive to said position command signal and provides a rudder position in response thereto.

30. The method for steering a watercraft of claim 29 wherein said rudder control unit includes a compensator configured to characterize spectral content of said position command signal to facilitate at least one of maintaining stability of said direction control system and increasing bandwidth of said direction control system.

31. The method for steering a watercraft of claim 29 wherein said rudder control unit includes a compensator configured to characterize spectral content of said position command signal such that said direction control system exhibits a bandwidth sufficient to facilitate generation of a rudder command signal by a position control process to maintain stability of said steer-by-wire system.

32. The method for steering a watercraft of claim 18 further including:

receiving an inclination signal from an inclination sensor; and generating and providing a command to at least one of an I/O trim and a trim tab to control watercraft inclination.

33. The method for steering a watercraft of claim 32 wherein said trim tab comprises a port trim tab and starboard trim tab to facilitate lateral inclination control.

34. A storage medium encoded with a machine-readable computer program code for steering a watercraft, said storage medium including instructions for causing a computer to implement a method comprising:

receiving a watercraft speed signal;

receiving a helm position signal receiving a helm torque sensor signal;

receiving a rudder position signal;

generating a helm command signal to a helm control system based on said helm torque signal, said helm position signal and said watercraft speed signal to provide tactile feedback to an operator, said tactile feedback incuding at least one of: a resistive force, a reaction force to an operator; an on center detent as a helm control moves thru a center position; and variable control stops to resist helm motion beyond a selected threshold;

generating a directional command signal to a direction control system based on said watercraft speed signal, said rudder position signal, and said helm position signal to control direction of said watercraft; and commanding a lateral thruster in cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

35. A computer data signal for steering a watercraft, said computer data signal including instructions for causing a computer to implement a method comprising:

receiving a watercraft speed signal;

receiving a helm position signal receiving a helm torque sensor signal;

receiving a rudder position signal;

generating a helm command signal to a helm control system based on said helm torque signal, said helm position signal and said watercraft speed signal to provide tactile feedback to an operator, said tactile feedback incuding at least one of: a resistive force, a reaction force to an operator; an on center detent as a helm control moves thru a center position; and variable control stops to resist helm motion beyond a selected threshold; and generating a directional command signal to a direction control system based on said watercraft speed signal, said rudder position signal, and said helm position signal to control direction of said watercraft; and commanding a lateral thruster in cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

36. A watercraft steer-by-wire control system comprising:

a direction control system responsive to a directional command signal for steering a watercraft, said direction control system including a rudder position sensor to measure and transmit a rudder position signal;

a helm control system responsive to a helm command signal for receiving a directional input to a helm from an operator and providing tactile feedback to an operator, said helm control system including a helm position sensor to produce and transmit a helm position signal, a master control unit in operable communication with said helm control system, and said direction control system, said master control unit includes a position control process for generating said directional command signal in response to said helm position signal, said position control process calculates and produces a variable steering ratio signal; and a lateral thruster in operable communication and cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

37. The watercraft steer-by-wire control system of claim 36 further including a watercraft speed sensor for producing a watercraft speed signal and wherein said position control process is responsive to said watercraft speed signal.

38. The watercraft steer-by-wire control system of claim 36 further including a watercraft mode selector for producing a mode selection signal and wherein said position control process is responsive to said mode selection signal.

39. The watercraft steer-by-wire control system of claim 36 further including a rudder force sensor in operable communication with said direction control system to produce and transmit a rudder force signal and wherein at least one of said direction control system and a torque control process is responsive to said rudder force signal.

40. The watercraft steer-by-wire control system of claim 36 further including a torque sensor to produce and transmit a helm torque signal, said master control unit includes a torque control process for generating said helm command signal based on said helm torque signal, said helm position signal and said watercraft speed signal.

41. The watercraft steer-by-wire control system of claim 40 wherein said torque control process includes an active damping process wherein a damping torque command signal is generated based on a time rate of change of said helm position signal and modified by said helm torque signal and said watercraft speed signal.

42. The watercraft steer-by-wire control system of claim 40 wherein said torque control process implements a compensator to configure spectral content of a damping torque command signal thereby generating a compensated torque command signal, said compensator is configured to facilitate at least one of a modification of the spectral content of said tactile feedback and maintaining stability of said watercraft steer-by-wire control system.

43. The watercraft steer-by-wire control system of claim 40 wherein said torque control process further implements a feel process comprising an assist sub-process responsive to a compensated torque command signal and said watercraft speed signal, which generates an assist torque command and a return sub-process responsive to said helm position signal and said watercraft speed signal, which generates a return torque command.

44. The watercraft steer-by-wire control system of claim 40 wherein said helm control system comprises a closed loop control system responsive to said helm command signal and said helm torque signal.

45. The watercraft steer-by-wire control system of claim 40 wherein said helm control system configured to exhibit a bandwidth sufficient to facilitate said torque control process maintaining stability of said watercraft steer-by-wire system.

46. The watercraft steer-by-wire control system of claim 40 wherein said helm control system comprises a helm control unit and a helm dynamics unit; said helm control unit is responsive to said helm command signal and said helm torque sensor signal and generates a torque command signal; said helm dynamics unit is responsive to said torque command signal and provides said tactile feedback in response thereto to an operator.

47. The watercraft steer-by-wire control system of claim 46 wherein said helm control unit includes a compensator configured to characterize spectral content of said torque command signal to facilitate at least one of maintaining stability of said helm control system and increasing bandwidth of said helm control system.

48. The watercraft steer-by-wire control system of claim 36 wherein said variable steering ratio is response to at least one of said helm position signal, a helm torque signal, a watercraft speed signal, and watercraft mode selector for producing a mode selection signal.

49. The watercraft steer-by-wire control system of claim 36 wherein said position control process further comprises a directional command process that calculates a theta correction and generates a theta corrected directional command signal from a variable steering ratio signal, and said helm position signal.

50. The watercraft steer-by-wire control system of claim 49 wherein said theta corrected directional command signal, is based on a helm torque signal.

51. The watercraft steer-by-wire control system of claim 36 wherein said tactile feedback includes at least one of: a reaction torque to an operator; an on center detent as a helm moves thru a center position; and variable control stops to resist helm motion beyond a selected threshold.

52. The watercraft steer-by-wire control system of claim 36 wherein said direction control system is configured to exhibit a bandwidth sufficient to facilitate said position control process maintaining stability of said watercraft steer-by-wire system.

53. The watercraft steer-by-wire control system of claim 36 wherein said direction control system comprises a closed loop control system responsive to said directional command signal and said rudder position signal.

54. The watercraft steer-by-wire control system of claim 36 wherein said direction control system comprises a rudder control unit and a rudder dynamics unit; said rudder control unit is responsive to said directional command signal and a rudder position signal and generates a position command signal; said rudder dynamics unit is responsive to said position command signal and provides a rudder position in response thereto.

55. The watercraft steer-by-wire control system of claim 54 wherein said rudder control unit includes a compensator configured to characterize spectral content of said position command signal to facilitate at least one of maintaining stability of said direction control system and increasing bandwidth of said direction control system.

56. The watercraft steer-by-wire control system of claim 36 wherein said at least one of said port command and said starboard command is based on at least one of a selected directional input from an operator, an operator input at said helm, and a mode selection signal.

57. The watercraft steer-by-wire control system of claim 56 wherein at least one of a port command and a starboard command is based on a selected directional input from an operator at said helm in excess of a selected threshold, wherein said lateral thruster is responsive to pulse width modulation scheme with a duty cycle responsive to at least one of a magnitude of said selected directional input, and a selected threshold from a variable stop of said helm control.

58. The watercraft steer-by-wire control system of claim 36 wherein said a lateral thruster is responsive to a selected gear or direction.

59. The watercraft steer-by-wire control system of claim 36 further including an inclination control system comprising:

an inclination sensor in operable communication with said master control unit;

at least one of an I/O trim and a trim tab, with an actuator in operable communication with said master control unit; and wherein said master control unit provides a trim command to at least one of said I/O trim and said trim tab to control watercraft inclination.

60. The watercraft steer-by-wire control system of claim 59 wherein said trim tab comprises a port trim tab and starboard trim tab to facilitate lateral inclination control.

61. A method for directing a watercraft with a watercraft steer-by-wire system comprising:

receiving a helm position signal;

receiving a rudder position signal;

generating a helm command signal to a helm control system based on said helm position signal to provide tactile feedback to an operator;

generating a directional command signal to a direction control system based on said rudder position signal, and said helm position signal to control direction of said watercraft;

producing a mode selection signal, wherein said generating a directional command signal is responsive to said mode selcetion signal; and commanding a lateral thruster in cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

62. The method for steering a watercraft of claim 61 further comprising receiving a watercraft speed signal and wherein at least one of said generating a helm command is further based on said watercraft speed signal and said generating a directional command signal is further based on said watercraft speed signal.

63. The method for steering a watercraft of claim 61 further comprising:

receiving a rudder force signal and wherein said a helm command signal is also based on said rudder force signal; and generating a directional command signal to a direction control system based on said watercraft speed signal, said helm position signal, and at least one of said rudder position signal and said rudder force signal.

64. The method for steering a watercraft of claim 61 further comprising receiving a helm torque signal and wherein said generating a helm command is further based on said helm torque signal.

65. The method for steering a watercraft of claim 64 further comprising:

generating damping torque command signal responsive to said helm torque signal, said helm position signal and a watercraft speed signal; wherein said damping torque command signal is responsive to a time rate of change of said helm position signal and said helm command signal is based on said damping torque command signal.

66. The method for steering a watercraft of claim 65 further comprising compensating said damping torque command signal to configure spectral content of said damping torque command signal and thereby, generating a compensated torque command signal, wherein said compensating includes filtering configured facilitate at least one of tailoring said tactile feedback, maintaining stability of said steer-by-wire system.

67. The method for steering a watercraft of claim 65 wherein said helm command signal is responsive to a combination of an assist torque command and a return torque command, and wherein said assist torque command is responsive to said compensated torque command signal and said watercraft speed signal; and said return torque command is responsive to said helm position signal and said watercraft speed signal.

68. The method for steering a watercraft of claim 61 further comprising calculating and producing a variable steering ratio signal in response to at least one of said helm position signal, a helm torque signal, a watercraft speed signal, and watercraft mode selector for producing a mode selection signal.

69. The method for steering a watercraft of claim 68 wherein said generating said directional command signal is based on said helm position signal, said helm torque signal, and said variable steering ratio signal.

70. The method for steering a watercraft of claim 61 wherein said tactile feedback includes at least one of: a reaction force to an operator; an on center detent as a helm control moves thru a center position; and variable control stops to resist helm motion beyond a selected threshold.

71. The method for steering a watercraft of claim 61 further including generating a torque command signal in a helm control system such that said helm control system exhibits a bandwidth sufficient to facilitate a torque control process generating said helm command signal to facilitate maintaining stability of said steering.

72. The method for steering a watercraft of claim 71 wherein said helm control system comprises a helm control unit and a helm dynamics unit, said helm control unit is responsive to a helm torque command signal and said helm torque signal and generates a torque command signal, said helm dynamics unit is responsive to said torque command signal and provides a reaction torque in response thereto to an operator.

73. The method for steering a watercraft of claim 72 wherein said helm control unit includes a compensator configured to characterize spectral content of said torque command signal to facilitate at least one of maintaining stability of said helm control system and increasing bandwidth of said helm control system.

74. The method for steering a watercraft of claim 61 further including generating a position command signal in a direction control system such that said direction control system exhibits a bandwidth sufficient to facilitate a position control process generating said directional command signal to facilitate maintaining stability of said steering.

75. The method for steering a watercraft of claim 61 wherein said direction control system comprises a rudder control unit and a rudder dynamics unit, said rudder control unit is responsive to said directional command signal and said rudder position signal and generates a position command signal; said rudder dynamics unit is responsive to said position command signal and provides a rudder position in response thereto.

76. The method for steering a watercraft of claim 75 wherein said rudder control unit includes a compensator configured to characterize spectral content of said position command signal to facilitate at least one of maintaining stability of said direction control system and increasing bandwidth of said direction control system.

77. The method for steering a watercraft of claim 75 wherein said rudder control unit includes a compensator configured to characterize spectral content of said position command signal such that said direction control system exhibits a bandwidth sufficient to facilitate generation of a rudder command signal by a position control process to maintain stability of said steer-by-wire system.

78. The method for steering a watercraft of claim 61 wherein said at least one of said port command and said starboard command is based on at least one of a selected directional input from an operator, an operator input at said helm, and a mode selection signal.

79. The method for steering a watercraft of claim 78 wherein at least one of a port command and a starboard command is based on a selected directional input from an operator at said helm in excess of a selected threshold, wherein said lateral thruster is responsive to pulse width modulation scheme with a duty cycle responsive to at least one of a magnitude of said selected directional input, and a selected threshold from a variable stop of said helm control.

80. The method for steering a watercraft of claim 61 wherein said a lateral thruster is responsive to a selected gear or direction.

81. The method for steering a watercraft of claim 61 further including:

receiving an inclination signal from an inclination sensor; and generating and providing a command to at least one of an I/O trim and a trim tab to control watercraft inclination.

82. The method for steering a watercraft of claim 81 wherein said trim tab comprises a port trim tab and starboard trim tab to facilitate lateral inclination control.

83. The storage medium encoded with a machine-readable computer program code for steering a watercraft, said storage medium including instructions for causing a computer to implement a method comprising:

receiving a helm position signal;

receiving a rudder position signal;

generating a helm command signal to a helm control system based on said helm position signal to provide tactile feedback to an operator;

generating a directional command signal to a direction control system based on said rudder position signal, and said helm position signal to control direction of said watercraft; and producing a mode selection signal, wherein said generating a directional command signal is responsive to said mode selcetion signal; and commanding a lateral thruster in cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

84. A computer data signal for steering a watercraft, said computer data signal including instructions for causing a computer to implement a method comprising:

receiving a helm position signal;

receiving a rudder position signal;

generating a helm command signal to a helm control system based on said helm position signal to provide tactile feedback to an operator;

generating a directional command signal to a direction control system based on said rudder position signal, and said helm position signal to control direction of said watercraft;

producing a mode selection signal, wherein said generating a directional command signal is responsive to said mode selcetion signal; and commanding a lateral thruster in cooperation with a rudder dynamics unit directing thrust to provide at least one of substantially lateral control and substantially yaw control to facilitate at least one of low speed and docking operations; wherein said lateral thruster is responsive to at least one of a port command and a starboard command.

* * * * *